US006110658A

United States Patent [19]

Honan et al.

[11] Patent Number: 6,110,658

[45] Date of Patent: Aug. 29, 2000

[54] CYAN COUPLER AND COMBINATION SOLVENT-CONTAINING PHOTOGRAPHIC ELEMENT AND PROCESS

[75] Inventors: James S. Honan, Spencerport; Raymond P. Scaringe, Rochester; Thomas A. Rosiek, Honeoye Falls, all of N.Y.

[73] Assignee: Eastman Kodak Company, Rochester, N.Y.

[21] Appl. No.: 09/266,234

[22] Filed: Mar. 10, 1999

[51] Int. Cl.[7] ..... G03C 1/38

[52] U.S. Cl. ..... 430/546; 430/377; 430/552; 430/553

[58] Field of Search ..... 430/546, 552, 430/553

[56] References Cited

U.S. PATENT DOCUMENTS

| | | | |
|---|---|---|---|
| 4,865,957 | 9/1989 | Sakai et al. | 430/505 |
| 5,004,675 | 4/1991 | Yoneyama et al. | 430/377 |
| 5,047,314 | 9/1991 | Sakai et al. | 430/505 |
| 5,047,315 | 9/1991 | Morigaki et al. | 430/544 |
| 5,057,408 | 10/1991 | Takahashi et al. | 430/546 |
| 5,162,197 | 11/1992 | Aoki et al. | 430/546 |
| 5,378,596 | 1/1995 | Naruse et al. | 430/549 |
| 5,585,230 | 12/1996 | Zengerle et al. | 430/546 |
| 5,686,235 | 11/1997 | Lau et al. | 430/553 |

*Primary Examiner*—Hoa Van Le
*Attorney, Agent, or Firm*—Arthur E. Kluegel

[57] ABSTRACT

Disclosed is a photographic element having a reduced rate of crystal formation comprising a silver halide emulsion layer having associated therewith:

(a) a phenolic cyan dye-forming "NB coupler";

(b) a first high boiling solvent having Formula (IV):

G—C—OO—$R^1$ (IV)

wherein:

$R^1$ is an alkyl or aryl groups; and

G is an alkyl (including cycloalkyl and aralkyl) containing linking group; and (c) one or more second high boiling solvents selected from phosphates, phosphonates, phosphine oxides, sulfoxides, and carbonamides, said second high boiling solvent being present in amounts (by weight) sufficient to reduce crystal formation in a dispersion of the coupler compared to a dispersion of the same coupler in a dispersion where the second solvent is replaced with a like amount of the first solvent.

30 Claims, No Drawings

CYAN COUPLER AND COMBINATION SOLVENT-CONTAINING PHOTOGRAPHIC ELEMENT AND PROCESS

FIELD OF THE INVENTION

The present invention relates to a color photographic element containing a particular type of phenolic cyan coupler in combination with two different types of high-boiling solvents.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green, and red light-sensitive layers typically contain yellow, magenta, and cyan dye-forming couplers, respectively. After exposure to light, color development is accomplished by immersing the exposed material in an aqueous alkali solution containing an aromatic primary amine color developing agent. The dye-forming couplers are selected so as to react with the oxidized color developing agent to provide yellow, magenta and cyan dyes in the so called subtractive color process to reproduce their complementary colors, blue, green and red as in the original image.

The important features for selecting the dye-forming coupler include, efficient reaction with oxidized color developing agent, thus minimizing the necessary amounts of coupler and silver halide in the photographic element; the formation of dyes with hues appropriate for the photographic use of interest, for color photographic paper applications this requires that dyes have low unwanted side absorption leading to good color reproduction in the photographic print; minimization of image dye loss contributing to improved image permanence under both ambient illumination and conventional storage conditions; and in addition the selected dye-forming coupler must exhibit good solubility in coupler solvents, provide good dispersibility in gelatin and remain stable during handling and manipulation for maximum efficiency in manufacturing processes.

In recent years, a great deal of study has been conducted to improve dye-forming couplers for silver halide photosensitive materials in terms of improved color reproducibility and image dye stability. However, further improvements are needed, particularly in the area of cyan couplers. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the dyes derived from them still suffer from poor stability to heat, humidity or light, low coupling efficiency or optical density, and in particular from undesirable blue and green absorptions which cause considerable reduction in color reproduction and color saturation.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729; and Japanese patent applications JP02035450 A2, JP01253742 A2, JP04163448 A2, JP04212152 A2, and JP05204110 A2. Even though cyan image dyes formed from these couplers show improved stability to heat and humidity, enhanced optical density and resistance to reduction by ferrous ions in the bleach bath, the dye absorption maxima ($\lambda$max) are too bathochromically shifted (that is, shifted to the red end of the visible spectrum) and the absorption spectra are too broad with considerable amounts of undesirable blue and green absorptions. Thus, these couplers are not practical for use in color papers.

The hue of a dye is a function of both the shape and the position of its spectral absorption band. Traditionally, the cyan dyes used in color photographic papers have had nearly symmetrical absorption bands centered in the region of 620 to 680 nm, preferably 630 to 660 nm, and more preferably 635 to 655 nm. Such dyes have rather large amounts of unwanted absorption in the green and blue regions of the spectrum.

More desirable would be a dye whose absorption band is asymmetrical in nature and biased towards the green region, that is, with a steep slope on the short wavelength side. Such a dye would suitably peak at a shorter wavelength than a dye with symmetrical absorption band, but the exact position of the desired peak depends on several factors including the degree of asymmetry and the shapes and positions of the absorption bands of the magenta and yellow dyes with which it is associated.

Recently, Lau et. al. in U.S. Pat. No. 5,686,235 describe a particular class of cyan dye-forming coupler that has been shown to improve thermal stability and hue, particularly, with decreased absorption in side bands and an absorption band that is asymmetrical in nature. However, it has been found that dispersions of these couplers are difficult to prepare free of crystalline material, and are not stable with time in cold storage. Other related patents are U.S. Pat. Nos. 5,047,314, 5,047,315, 5,057,408, and 5,162,197.

Large-scale manufacturing of photographic materials can be severely hindered when crystalline material is present in dispersions and coating melts of such dispersions. This can lead to difficulty in manufacturing by plugging filters and causing defects in coatings of photographic materials. It is therefore desirable to use dispersions which have few, if any, crystals and are stable in cold storage from the time of preparation until the time of use.

This invention relates to so-called "NB couplers" which are defined more fully hereinafter. It has been found that preparing substantially crystal free dispersions of these "NB couplers" can be difficult. It appears that the property of these couplers that enables the dye formed by them to shift hue may at the same time be responsible for difficulties in the formation of unwanted crystals. Appropriate selection of a coupler solvent can reduce the amount of crystals to an acceptable level. However, it has been found that some "NB couplers", particularly those with high melting points, can fail to disperse in these preferred solvents as cleanly as couplers of lower melting points.

The use of various high boiling coupler solvents is disclosed in the following U.S. patents: U.S. Pat. No. 5,726,003, U.S. Pat. No. 5,047,315, U.S. Pat. No. 5,057,408, U.S. Pat. No. 5,356,768, U.S. Pat. No. 4,882,267, U.S. Pat. No. 4,767,697, U.S. Pat. No. 4,217,410, and U.S. Pat. No. 4,840,878. Experimental work contained in this specification has shown that a number of these known solvents may be employed to reduce the amount of crystals formed, but these solvents also result in decreased coupler reactivity and increased unwanted green light absorption.

The problem to be solved is to provide a photographic element and process in which a dispersion containing an "NB coupler" exhibits reduced crystal formation while maintaining satisfactory levels of reactivity and unwanted green light absorption.

SUMMARY OF THE INVENTION

The invention provides a photographic element comprising a silver halide emulsion layer having associated therewith:

(a) a phenolic cyan dye-forming "NB coupler";

(b) a first high boiling solvent having Formula (IV):

$$G—C—OO—R^1 \quad (IV)$$

wherein:

$R^1$ is an alkyl or aryl groups; and

G is an alkyl (including cycloalkyl and aralkyl) containing linking group; and (c) one or more second high boiling solvents selected from phosphates, phosphonates, phosphine oxides, sulfoxides, and carbonamides, said second high boiling solvent being present in amounts (by weight) sufficient to reduce crystal formation in a dispersion of the coupler compared to a dispersion of the same coupler in a dispersion where the second solvent is replaced with a like amount of the first solvent.

The invention also provides a process for forming an image in an element of the invention.

The invention provides a photographic element and process in which a dispersion containing an "NB coupler" exhibits reduced crystal formation while maintaining satisfactory levels of reactivity and unwanted green light absorption.

DETAILED DESCRIPTION OF THE INVENTION

The element and process of the invention are described in the Summary of the Invention. The invention relates to a photographic element containing a cyan dye-forming coupler which upon processing in the conventional manner forms in the exposed areas, a cyan dye whose absorption spectrum is hypsochromically shifted (that is, shifted toward the blue end of the spectrum) and sharp-cutting on its short wavelength side. The former is particularly necessary for prints obtained in accordance with conventional printing processes, and the latter improves color reproduction and provides high color saturation. In accordance with the invention, these cyan couplers are advantageously combined with a certain solvent combination.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the inventin as the formula (IA)

(IA)

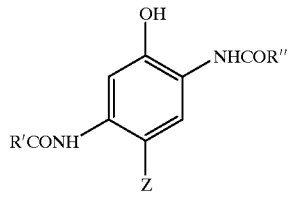

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment the "NB coupler" is represented by formula (I):

(I)

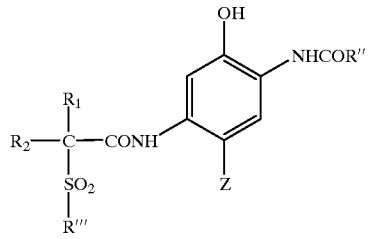

wherein

R" and Z are as hereinbefore defined;

$R_1$ and $R_2$ are independently hydrogen or an unsubstituted or substituted alkyl group; and R'" is independently selected from alkyl, aryl, amino, alkoxy and heterocyclyl groups.

In the preferred embodiment the coupler of formula (I) is a 2,5-diamido phenol in which the 5-amido moiety is an amide of a carboxylic acid which is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5–10 membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula (I), when R'" is alkyl it may be unsubstituted or substituted with a substituent such as halogen or alkoxy. When R'" aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, $-OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

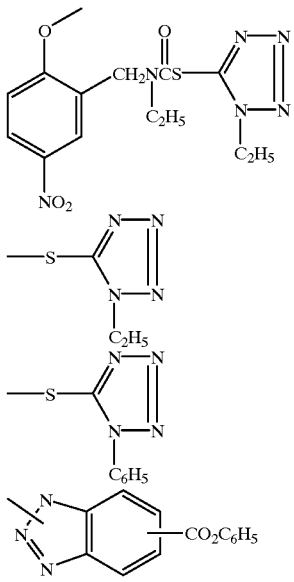

-continued

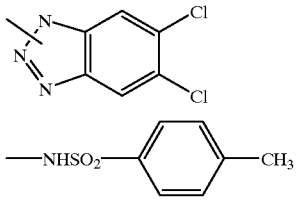

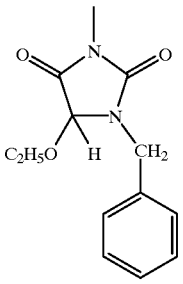

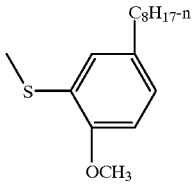

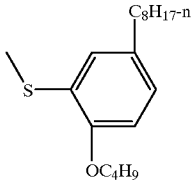

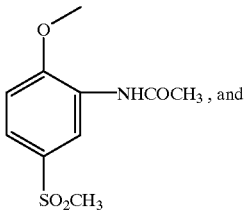

-continued

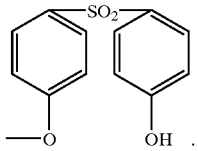

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group contains a ballast, it is often necessary to ballast the other substituents as well, since that group is eliminated from the molecule upon coupling; thus, the ballast is most advantageously provided as part of groups other than the coupling-off group.

It is believed that the solvents of the invention are particularly useful with couplers of the invention for which the melting point is greater that 110° C., greater that 130° C., and especially greater that 150° C.

The following examples further illustrate the "NB couplers" useful in the invention. It is not to be construed that the present invention is limited to these examples.

IC-1

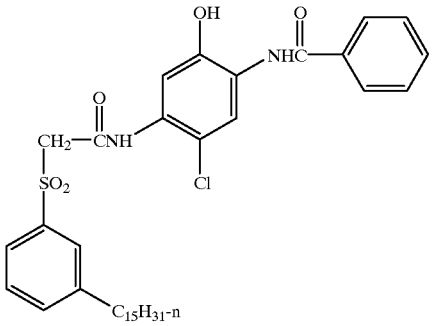

-continued
IC-2
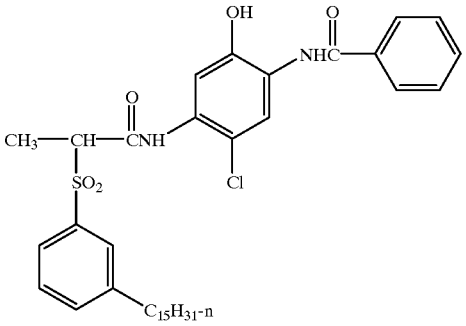
IC-3
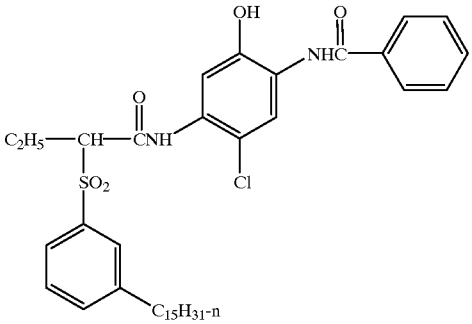
IC-4
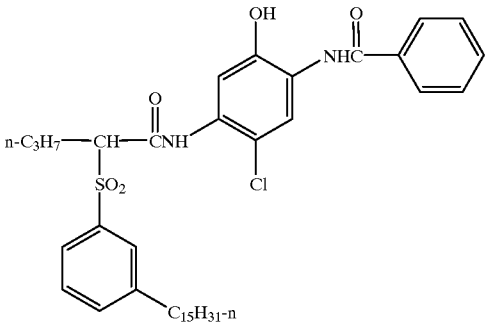
IC-5
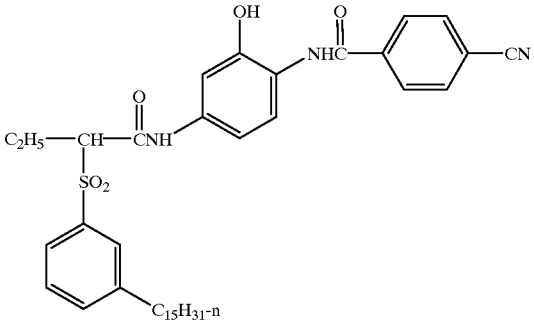

-continued
IC-6
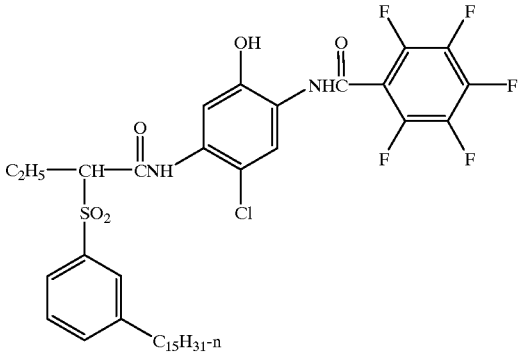
IC-7
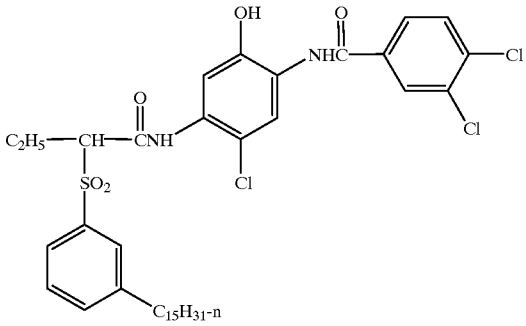
IC-8
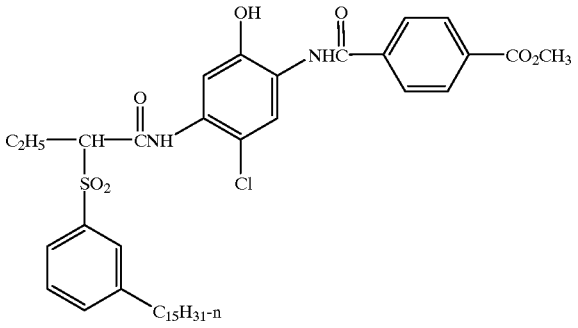
IC-9
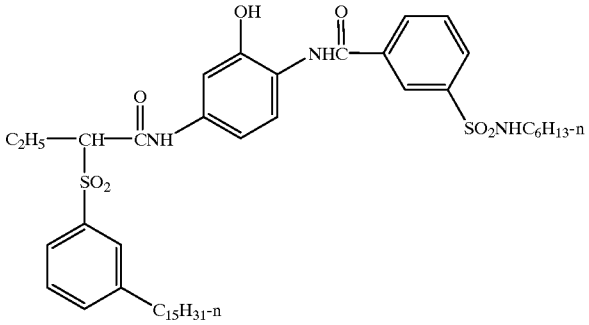

-continued
IC-10
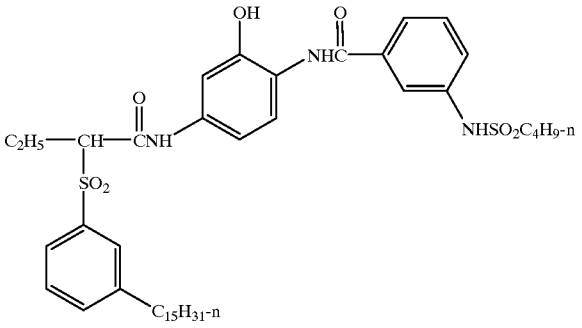
IC-11
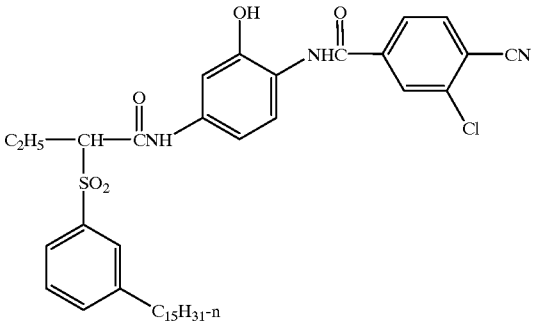
IC-12
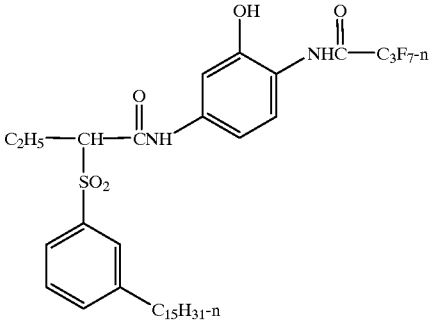
IC-13
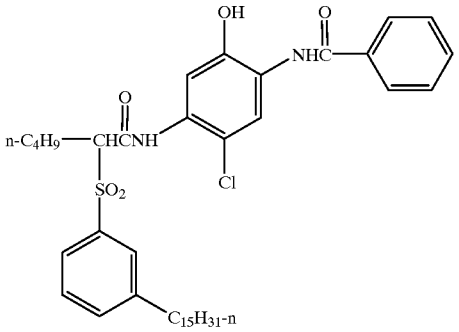

-continued
IC-14
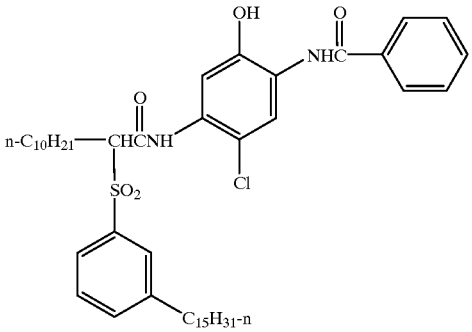
IC-15
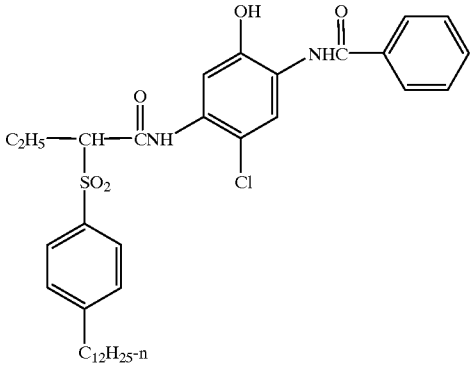
IC-16
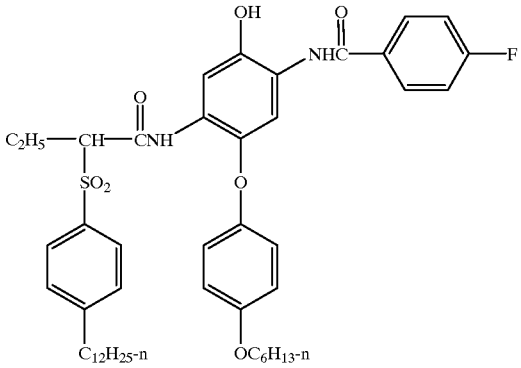
IC-17
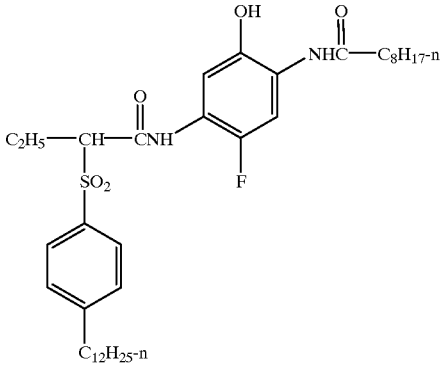

-continued
IC-18
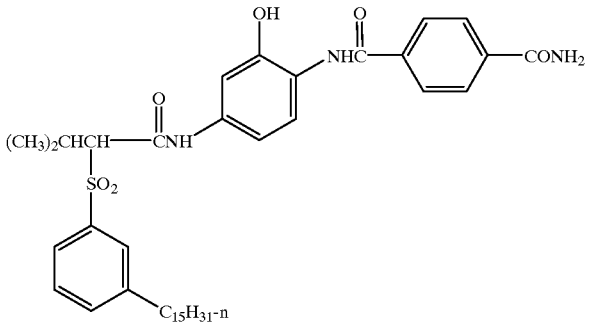
IC-19
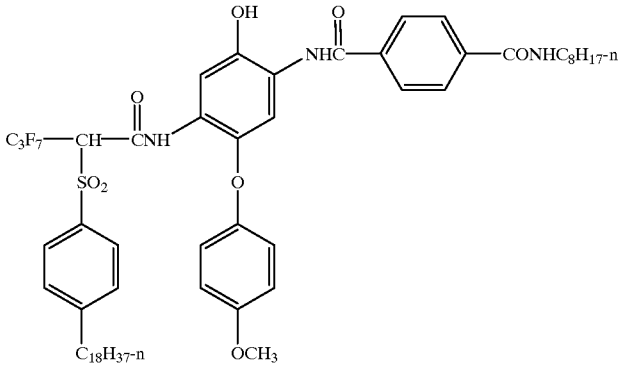
IC-20
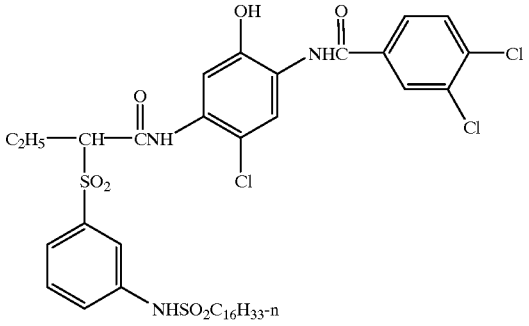
IC-21
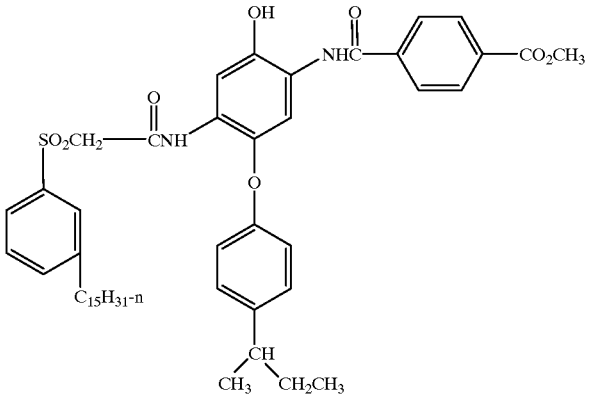

-continued
IC-22
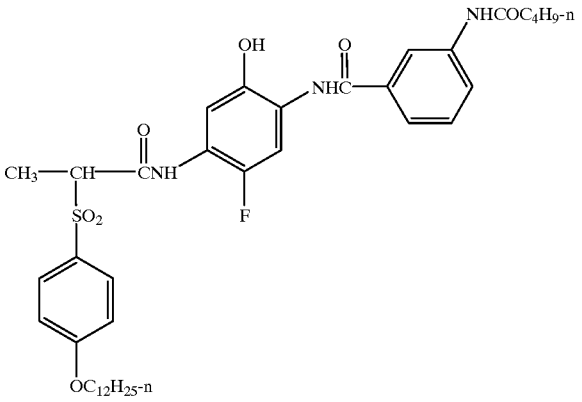
IC-23
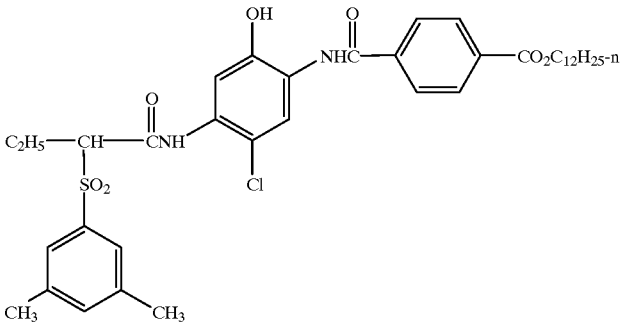
IC-24
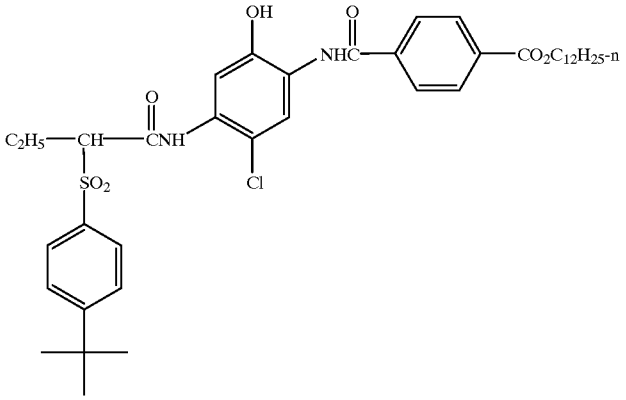
IC-25
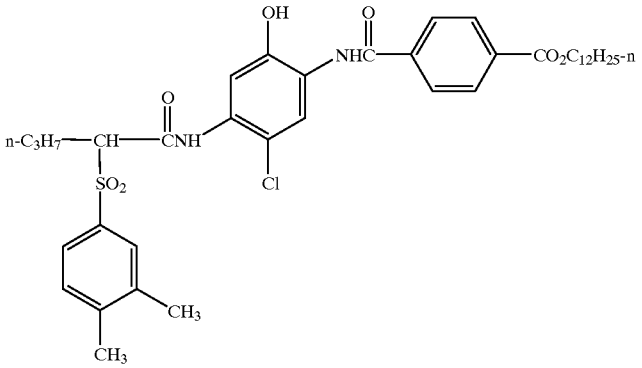

-continued
IC-26
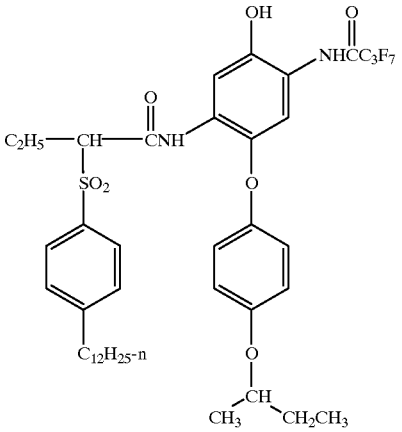
IC-27
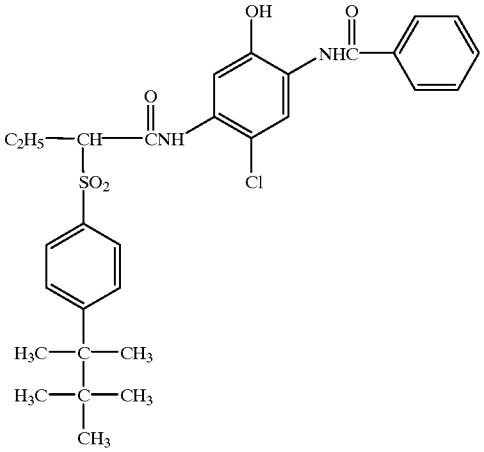
IC-28
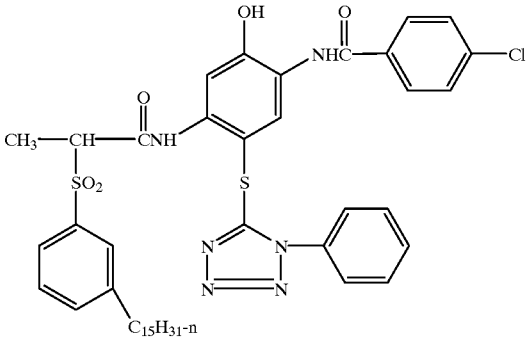
IC-29
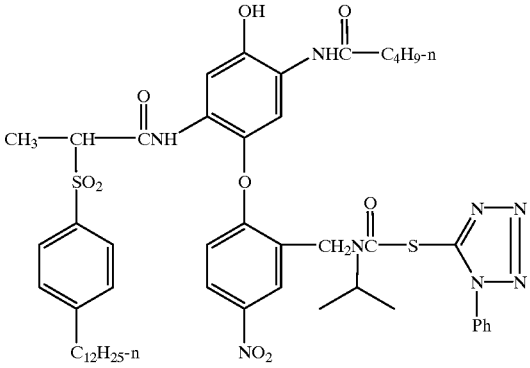

-continued
IC-30
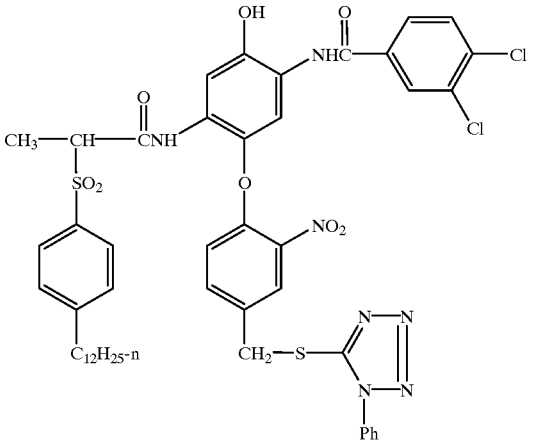
IC-31
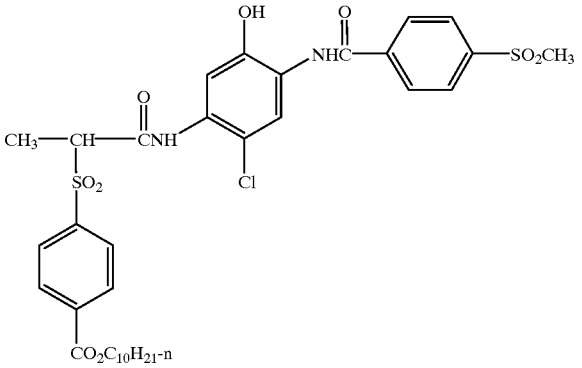
IC-32
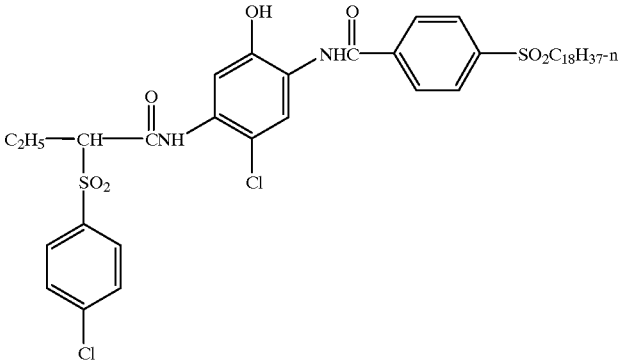
IC-33
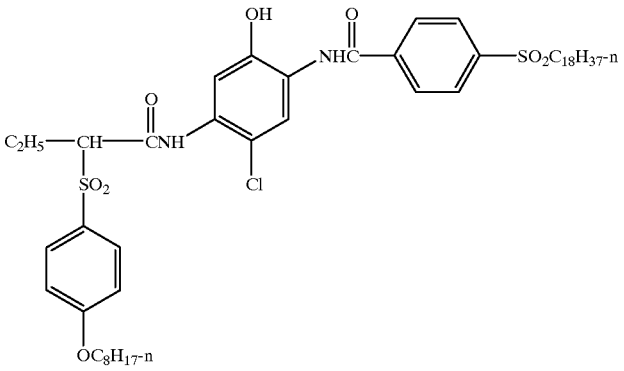

-continued
IC-34
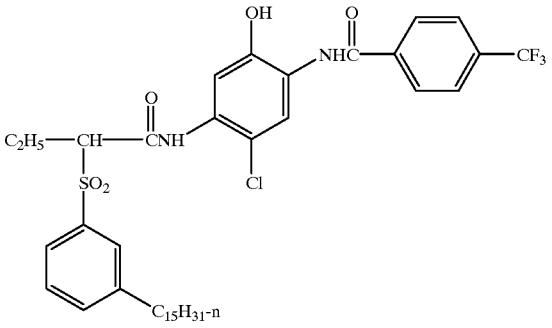
IC-35
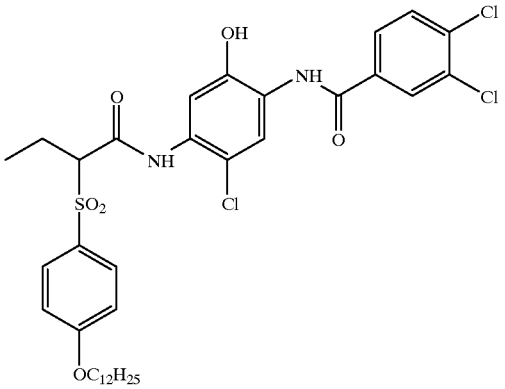
IC-36
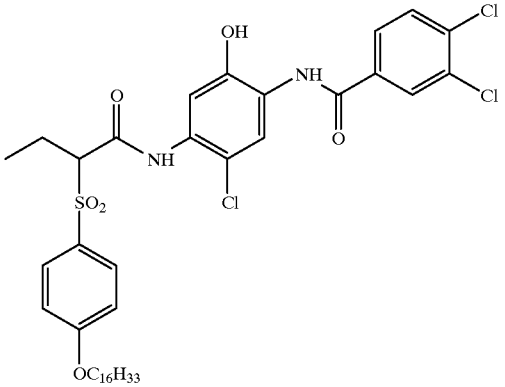
IC-37
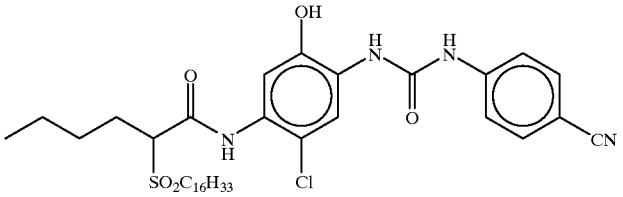

-continued

IC-38

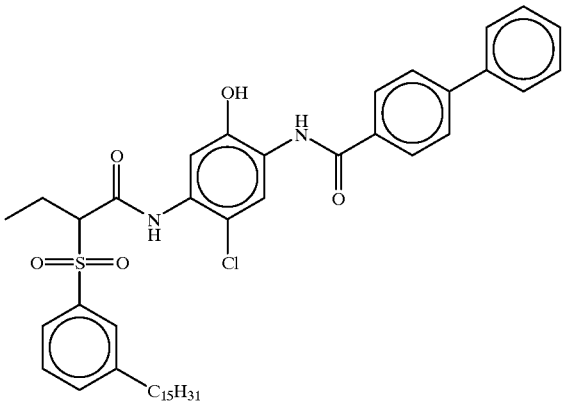

IC-39

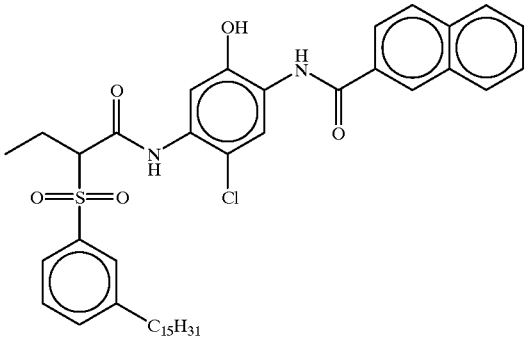

IC-40

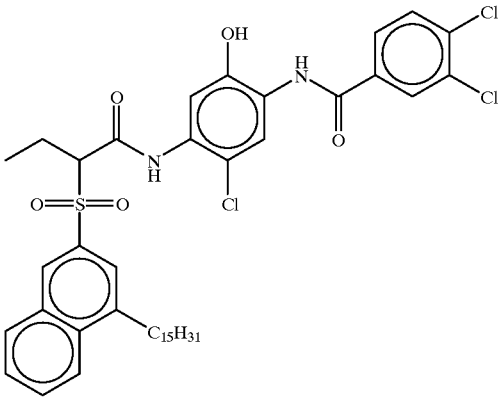

Preferred couplers are IC-3, IC-7, IC-35, and IC-36 because of their suitably narrow left bandwidths.

Using formula I, the following are examples of high melting point couplers of the invention wherein $R_1$ is a hydrogen atom, $R_2$ is —$C_2H_5$ (except H for IC-1, n-$C_4H_9$, for IC-13, and n-$C_{10}H_{21}$ for IC-14), Z is Cl, and R'" is a phenyl group substituted in the para position as denoted by Ra in the table below. Other examples include

| Coupler | Ra = $C_6H_5$— with substituent as indicated | R" | Melting Point-° C. |
|---|---|---|---|
| IC-1 | -3-$C_{15}H_{31}$ | phenyl | 173–174 |
| IC-7 | -3-$C_{15}H_{31}$ | 3,4 dichlorophenyl | 125 |
| IC-13 | -3-$C_{15}H_{31}$ | phenyl | 114–116 |
| IC-14 | -3-$C_{15}H_{31}$ | phenyl | 89–90 |
| IC-15 | -4-$C_{12}H_{25}$ | phenyl | 128–130 |
| IC-35 | -4-$OC_{12}H_{25}$ | 3,4 dichlorophenyl | 165–167 |
| IC-36 | -4-$OC_{16}H_{33}$ | 3,4 dichlorophenyl | 156–158 |
| IC-41 | -4-$OCH_2CH_2OC_4H_9$ | 4-chlorophenyl | 199–200 |

-continued

| Coupler | Ra = $C_6H_5$— with substituent as indicated | R" | Melting Point-° C. |
|---|---|---|---|
| IC-42 | -4-$OC_{12}H_{25}$ | 4-chlorophenyl | 166–167 |
| IC-43 | -4-$OC_{10}H_{21}$ | 3,4 dichlorophenyl | 165–166 |
| IC-44 | -4-$OC_{11}H_{23}$ | 3,4 dichlorophenyl | 170–172 |
| IC-45 | -4-$OC_{14}H_{29}$ | 3,4 dichlorophenyl | 157–159 |
| IC-46 | -4-$OCH_2CH_2OCH_2CH_2OC_{12}H_{25}$ | 3,4 dichlorophenyl | 182–183 |
| IC-47 | -4-$OCH_2CH_2OCH_2CH_2OC_8H_{17}$ | 3,4 dichlorophenyl | 208–210 |
| IC-48 | -4-$OCH_2CH(C_2H_5)C_4H_9$ | 3,4 dichlorophenyl | 152–153 |
| IC-49 | -4-$OCH_2CH(CH_3)CH_2CH_2CH_2CH(CH_3)CH_3$ | 3,4 dichlorophenyl | 161–163 |

Unless otherwise specifically stated, substituent groups identified throughout this specification which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The first high-boiling solvent in the invention is a compound having the formula (IV)

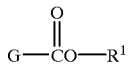

(IV)

wherein $R^1$ is an alkyl or aryl group; and

G is an alkyl (including cycloalkyl and aralkyl) group.

$R^1$ is preferably an alkyl group, and in particular one having 1 to 20 carbon atoms, such as methyl, ethyl, propyl, butyl, pentyl, octyl, 2-ethylhexyl, decyl, oleyl, linalyl, which may be substituted with one or more groups such as a hydroxy, alkoxy, alkoxycarbonyl or carboxylic ester group or $R^1$ is an aryl group, which may be substituted, for example, with one or more alkyl groups such as a methyl group or $R^1$ is an aralkyl group, such as benzyl.

G is preferably an alkyl group, and in particular one having 1 to 20 carbon atoms, such as methyl, ethyl, propyl, butyl, pentyl, hexyl, heptyl, octyl, nonyl, decyl, undecyl, dodecyl, oleyl, linalyl, cyclohexyl or cyclohexenyl. G may be substituted along the alkyl chain by one or more groups which are the same or different selected from —OH, —$OR^1$, $OCOR^1$, —$COR^1$, —COOH, —$COOR^1$, —CN or halogen, preferably with a hydroxy and/or one or more carboxylic ester groups. Moreover when G is an aralkyl group it may be substituted in the aryl ring with one or more groups, such as with a methoxy group, or on the alkyl part as described above for the alkyl chain.

The high boiling solvent of the invention can more specifically be described by the general formula (II), $$R^3OO—C—(—G—)—C—OO—R^4 \quad (II)$$

wherein $R^3$ and $R^4$ represent independently selected alkyl or aryl groups. G represents an alkyl (including cycloalkyl and aralkyl) containing linking group.

$R^3$ and $R^4$ are independently selected alkyl groups such as methyl, ethyl, propyl, butyl, octyl, 2-ethylhexyl, and decyl groups; and aryl groups such as a methylphenyl group.

G represents an alkyl containing linking group, either linear or cyclized, such as methyl, ethyl, propyl, butyl, pentyl, hexyl, heptyl, octyl, nonyl, decyl, undecyl, dodecyl, cyclohexyl, or cyclohexenyl. G may also be substituted along the alkyl chain by one or more groups such as —OH, —OCOR, —COR, —OR, —COOR, —CN, and halogen where R is H or a substituent.

Preferably $R^3$ and $R^4$ are alkyl groups and G is an unsubstituted alkyl group or an alkyl group substituted with a hydroxy and/or one or more carboxylic ester groups.

The term high-boiling means solvents boiling above 100° C., typically above 140° C. The following solvents further illustrate a preferred embodiment of the invention. It is not to be construed that the present invention is limited to these examples.

S-1

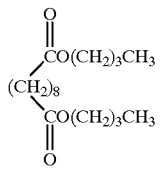

-continued

S-2

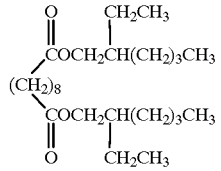

S-3

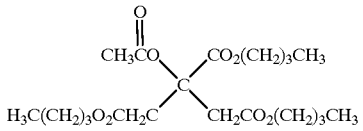

S-4

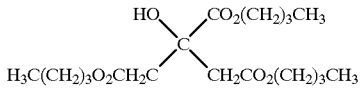

S-5

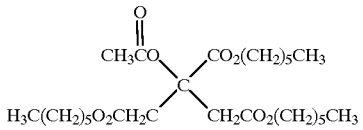

S-6

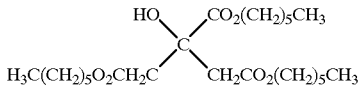

S-7

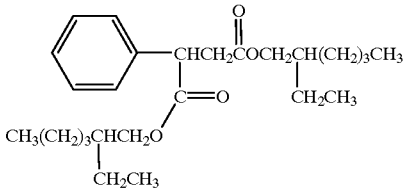

S-8

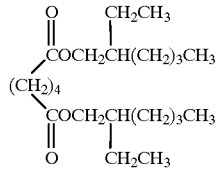

S-9

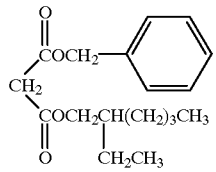

S-10

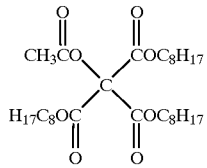

-continued
S-11
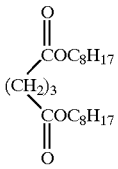
S-12
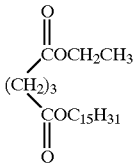
S-13
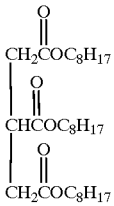
S-14
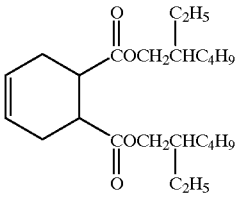
S-15
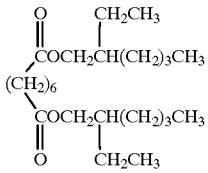
S-16
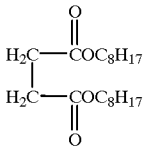
S-17
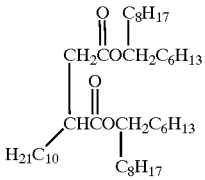
S-18
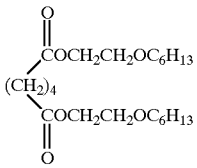
-continued
S-19
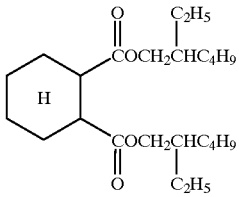
S-20
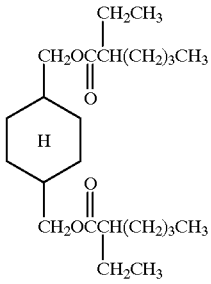
S-21
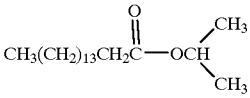
S-22
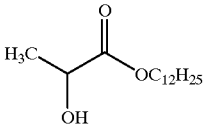
S-23
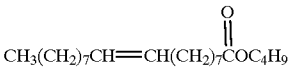
S-24
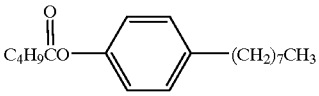
S-25
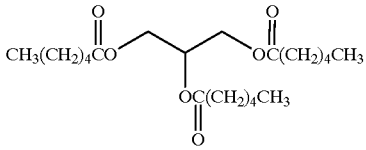
S-26
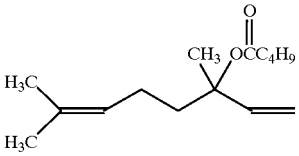
S-27
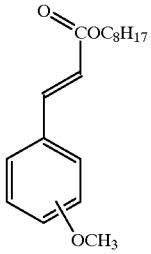

-continued

S-28

$$ClCH_2CH_2\overset{\overset{O}{\|}}{C}O(CH_2)_{13}CH_3$$

S-29

$$CH_3(CH_2)_3\overset{\overset{C_2H_5}{|}}{C}H\underset{\underset{O}{\|}}{C}OCH_2\overset{\overset{C_2H_5}{|}}{C}H(CH_2)_3CH_3$$

S-30

$$H_3C(CH_2)_2\overset{\overset{O}{\|}}{C}O(CH_2)_{10}OH$$

S-31

$$CH_3\overset{\overset{O}{\|}}{C}O(CH_2)_9\overset{\overset{O}{\|}}{C}OC_8H_{17}$$

S-32

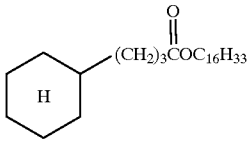

The second solvents of the invention may be represented by the following formulas V through IX. Formula V is a phosphate of the formula:

$$O{=}P(OR)_3 \qquad \text{V}$$

in which each R group is an independently selected alkyl or aryl group. Examples of suitable phosphate solvents are as follows:

V-1 tricresyl phosphate

V-2 tri-2-ethylhexyl phosphate

V-3 tri-m-tolyl phosphate

V-4 trihexyl phosphate

V-5 diphenyl 2-ethyl hexyl phosphate

V-6 tricyclohexyl phosphate

Formula VI is a phosphonate of the formula:

$$O{=}PR(OR)_2 \qquad \text{VI}$$

in which each R group is an independently selected alkyl or aryl group. Examples of suitable phosphonates are the following.

VI-1 dihexyl hexylphosphonate

VI-2 diethyl tetradecylphosphonate

VI-3 diethyl dodecylphosphonate

Formula VII is a phosphine oxid of the formula:

$$O{=}P(R)_3 \qquad \text{VII}$$

in which each R group is an independently selected alkyl or aryl group. Examples of suitable phosphine oxides are the following:

VII-1 trioctyl phosphine oxide

VII-2 trihexyl phosphine oxide

VII-3 bis(2,4,4-trimethylpentyl) octylphosphine oxide

VII-4 octadecyloxy (di(dimethylamino)) phosphine oxide

Formula VIII is a sulfoxide solvent of the formula:

$$O{=}S(R)R \qquad \text{VIII}$$

in which each R group is an independently selected alkyl or aryl group. Examples suitable sulfoxides are the following:

VIII-1 bis(2-ethylhexyl)sulfoxide

VIII-2 t-dodecyl-n-octyl sulfoxide

VIII-3 dodecyl-2-ethylhexyl sulfoxide

VIII-4 hexyl-2-hexyl-1-dodecyl sulfoxide

VIII-5 dodecyl-2,4-diisopropylphenyl sulfoxide

Formula IX is a carbonamide solvent of the formula:

$$O{=}CR(NR(R)) \qquad \text{IX}$$

in which each R group is an independently selected alkyl or aryl group. Examples of suitable carbonamides are:

IX-1 n,n-diethyldodecanamide

IX-2 n,n-dibutyldodecanamide

IX-3 n,n-butylacetanilide

IX-4 4-(1-butylpentyl)pyridine

IX-5 n-2-ethylhexyldodecanamide

IX-6 n,n-dipropyldodecanamide

IX-7 n,n-diethyl-m-toluamide

IX-8 n-benzyl-n-methyldodecanamide

IX-9 1-dodecyl-2-pyrrolidinone

IX-10 dioctyl amine

IX-11 n,n,n',n'-tetrahexylsuccinamide

IX-12 n,n,n',n'-tetrapentylphthalamide

IX-13 n,n-dimethyl-n', n'-dioctylurea

The second solvents of the combination are typically employed in a combined amount so as to provide a weight ratio of first solvent to second solvent in the range of about 9:1 to 1:99, suitably 7:1 to 1:3, and generally 4:1 to 1:1. Desirably the weight ratio of all of the solvents to the coupler is 0.5 to 10:1, suitably from 1:1 to 8:1 and generally 1:1 to 5:1.

The stabilizers of the invention can be described by the general Formula (III):

(III)

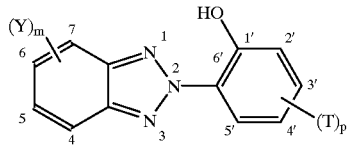

wherein each Y is an independently selected substituent and m is 0 to 4; and each T is an independently selected substituent and p is 0 to 4.

Suitably each Y is independently selected from hydrogen, halogen, nitro, and a substituent selected from the group consisting of unsubstituted or substituted alkyl, aryl, alkoxy, aryloxy, acyloxy, alkyl- or aryl-thio, mono- or di-alkylamino, acylamino, alkoxycarbonyl and a 5-membered or 6-membered heterocyclic group containing a nitrogen, oxygen or sulfur atom, and m is 0 to 4; and each T is independently selected from hydrogen, halogen and a substituent selected from the group consisting of unsubstituted or substituted alkyl, aryl, alkoxy, aryloxy, acyloxy, alkyl- or aryl-thio, mono- or di-alkylamino, acylamino, and a 5-membered or 6-membered heterocyclic group containing a nitrogen, oxygen or sulfur atom, and p is 0 to 4.

More preferably the 5-position of the benzotriazole ring is unsubstituted or substituted with an unsubstituted alkyl group and/or the 6-position is unsubstituted or substituted with a chlorine atom. Furthermore the 3' and 5' positions of the phenyl ring are preferably unsubstituted and the 2'-and/or 4'-positions are preferably substituted with an unsubstituted or substituted alkyl group, especially a branched alkyl group such as a t-butyl, t-pentyl or 2-ethylhexyl group. More preferably the ring is di-substituted at the 2'-and 4'-positions.

The following stabilizers further illustrate the invention. It is not to be construed that the present invention is limited to these examples.

ST-1

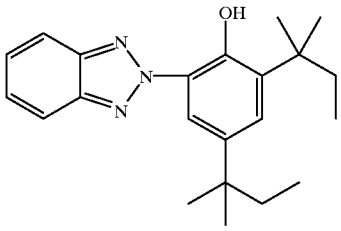

ST-2

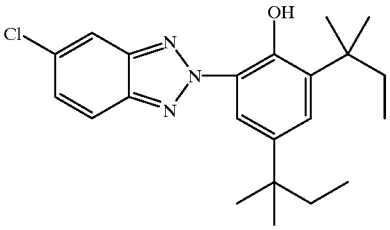

ST-3

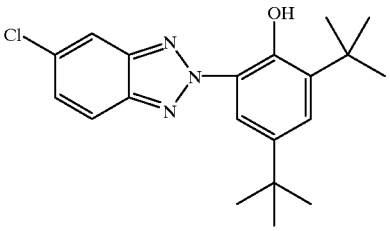

ST-4

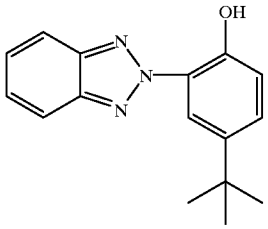

ST-5

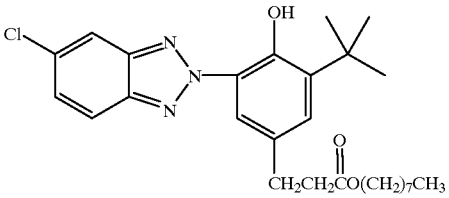

-continued

ST-6

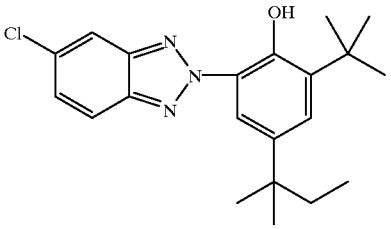

ST-7

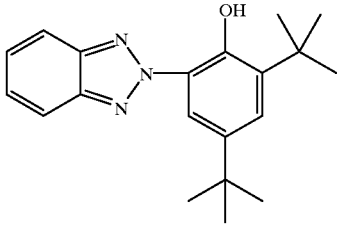

ST-8

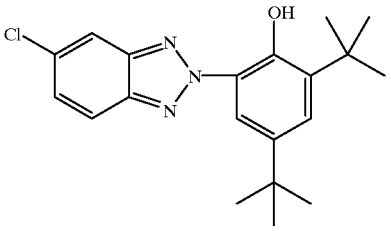

ST-9

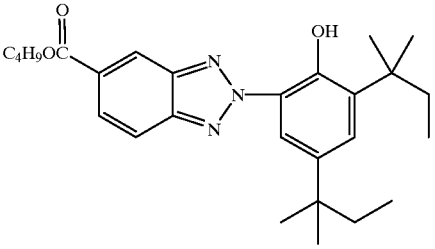

ST-10

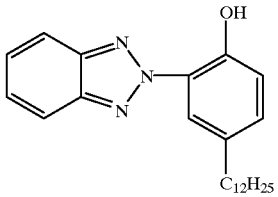

ST-11

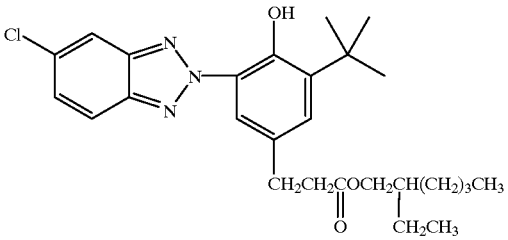

-continued

ST-12

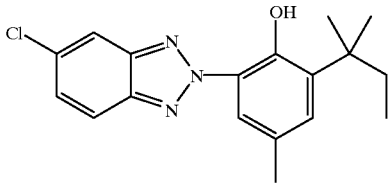

ST-13

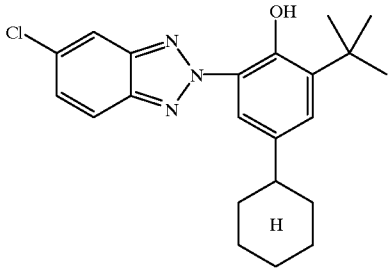

ST-14

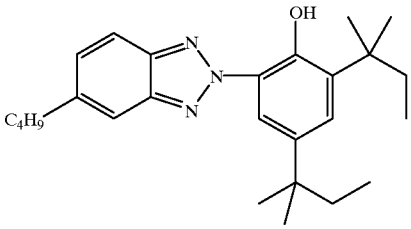

ST-15

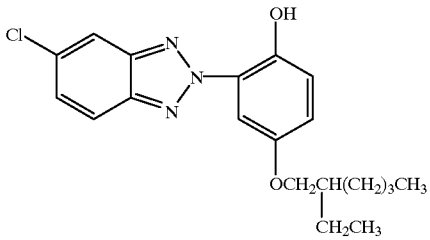

ST-16

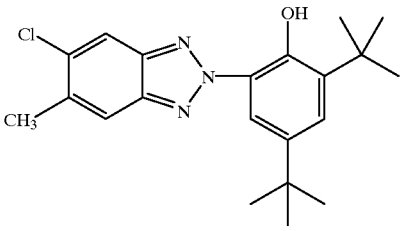

ST-17

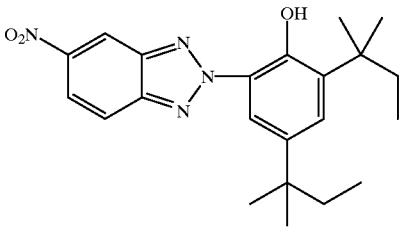

-continued

ST-18

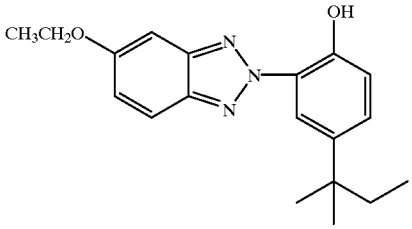

ST-19

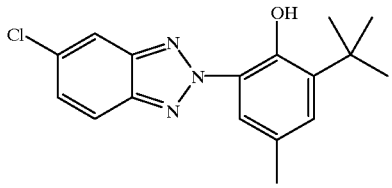

ST-20

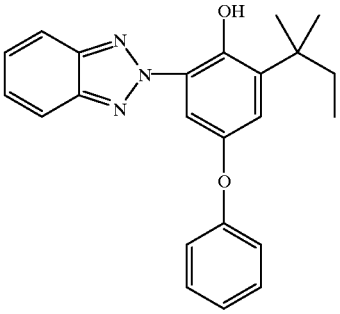

ST-21

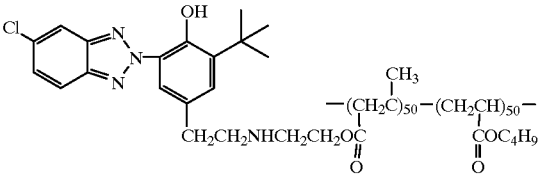

ST-22

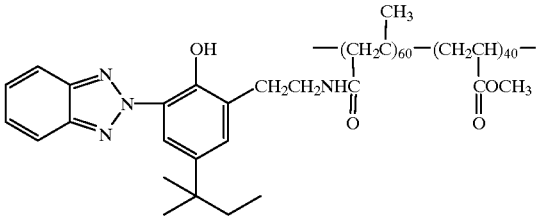

Embodiments of the invention enable the use of lower amounts of coupler and silver by improving the efficiency with which oxidized color developer reacts with the coupler to form dye. Embodiments of the invention exhibit reduction of low unwanted side-band absorption, especially unwanted green absorption and provide dye evidencing improved stability to light, heat, and humidity and improved hue.

The dispersion of the "NB Couplers" and stabilizers for use in the invention can be prepared by dissolving the materials in one or more high-boiling permanent organic solvents, including those solvents represented by formula (II), with or without a low-boiling or partially water-soluble auxiliary organic solvent. The resulting organic solution may then be mixed with an aqueous gelatin solution, and the mixture passed through a mechanical mixing device suitable for high-shear or turbulent mixing generally suitable for preparing photographic emulsified dispersions, such as a colloid mill, homogenizer, microfluidizer, high-speed mixer, ultrasonic dispersing apparatus, blade mixer, device in which a liquid stream is pumped at high pressure through an orifice or interaction chamber, Gaulin mill or blender to form small particles of the organic phase suspended in the aqueous phase. More than one type of device may be used to prepare the dispersions. The auxiliary organic solvent may then removed by evaporation, noodle washing, or membrane dialysis. The dispersion particles preferably have an average particle size of less than 2 μm, generally from about 0.02 to 2 μm, more preferably from about 0.02 to 0.5 μm, especially from about 0.02 to 0.3 μm. These methods are described in detail in U.S. Pat. Nos. 2,322,027, 2,787,544, 2,801,170, 2,801,171, 2,949,360, and 3,396,027, the disclosures of which are incorporated by reference herein.

Examples of suitable auxiliary solvents which can be used in the present invention include: ethyl acetate, isopropyl acetate, butyl acetate, ethyl propionate, 2-ethoxyethylacetate, 2-(2-butoxyethoxy) ethyl acetate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane and 1,2-dichloropropane.

The aqueous phase of the coupler dispersions for use in the invention preferably comprise gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid), polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-onic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

In an alternative embodiment, the "NB Coupler" may be dispersed without any high-boiling organic solvent. This could take the form of microprecipitated dispersions of photographic couplers prepared by solvent and/or pH shift techniques (see references: U.K. Patent No. 1,193,349; Research Disclosure 16468, December 1977 pp.75–80; U.S. Pat. Nos. 4,970,139; 5,089,380; 5,008,179; 5,104,776). These no-solvent coupler dispersions could be combined with or included in association with a separate dispersion containing the high boiling solvents useful in the invention.

Aqueous dispersions of high-boiling solvents of the invention can be prepared similarly to the coupler dispersion, e.g., by adding the solvent to an aqueous medium and subjecting such mixture to high shear or turbulent mixing as described above. The aqueous medium is preferably a gelatin solution, and surfactants and auxiliary solvents may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill, homogenizer, microfluidizer, high speed mixer or ultrasonic dispersing apparatus to form small particles of the organic solvent suspended in the aqueous phase. If an auxiliary solvent is employed, it is then subsequently removed by evaporation, noodle washing, or membrane dialysis. These methods are described in detail in the aforementioned references on dispersion making. The solvent dispersion may be a "blank" dispersion which does not contain any additional photographically useful compounds, or the solvent may be part of a photographically useful compound dispersion.

An aqueous coating solution in accordance with the present invention may then be prepared by combining a cyan coupler dispersion with the separate dispersion of the high-boiling organic solvent of the invention. Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50° C.) for a short period of time (e.g. 5 min to 4 hr) prior to coating.

Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent layer.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

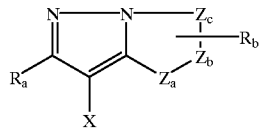

MAGENTA-2

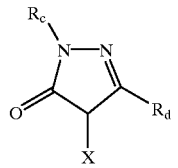

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

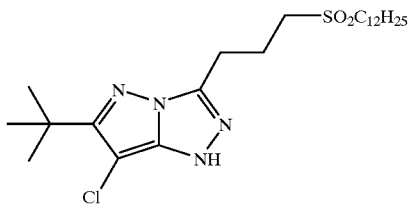

M-2

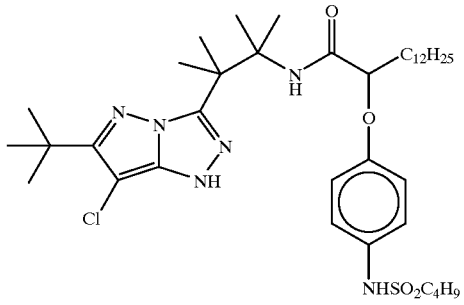

M-3

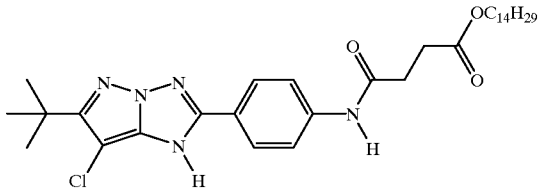

-continued

M-4

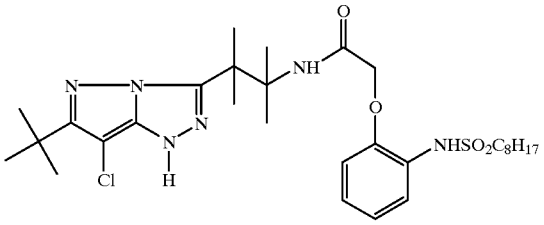

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 3,960,570, 4,022,620, 4,443,536, 4,910,126 and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

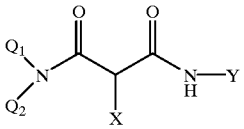

-continued

YELLOW-2

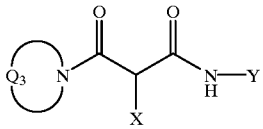

YELLOW-3

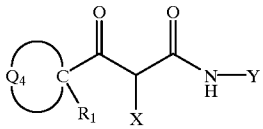

YELLOW-4

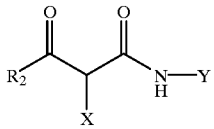

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and Q2 each represent an alkyl group, an aryl group, or a heterocyclic group, and $R_2$ represents an aryl or tertiary alkyl group.

Preferred yellow couplers can be of the following general structures

Y-1

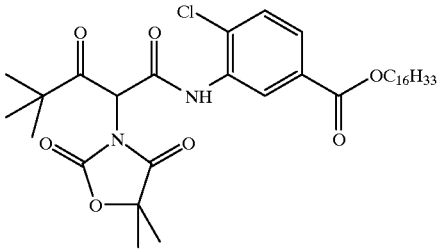

-continued

Y-2

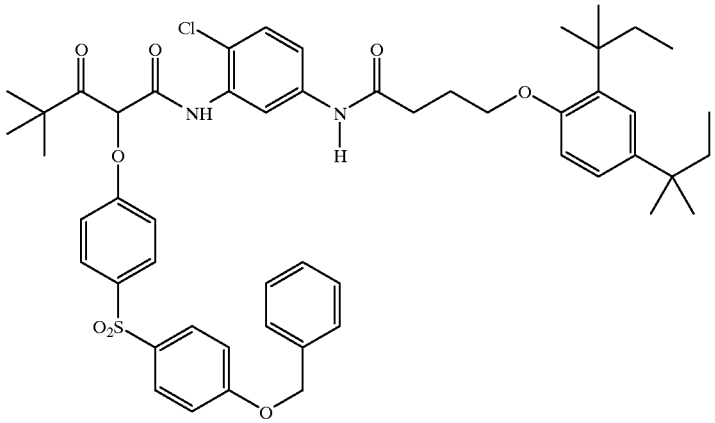

Y-3

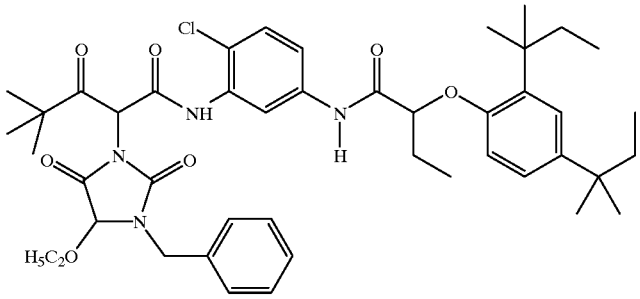

Y-4

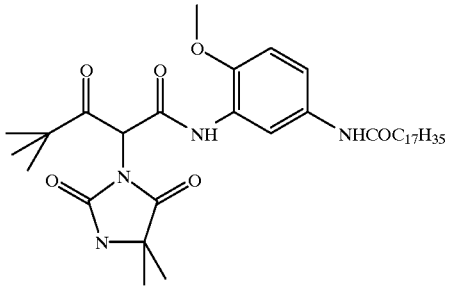

Y-5

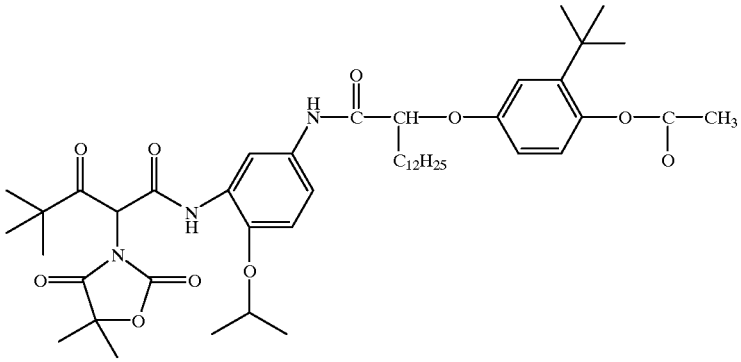

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anticolor-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959. Useful supports include those described in U.S. Pat. No. 5,866,282.

Any silver halide combination can be used for the photographic element, such as silver chloride, silver chlorobromide, silver chlorobromoiodide, silver bromide, silver bromoiodide, or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The coupler dispersions could be coated with emulsions to form photographic elements at very low levels of silver (less than 100 mg/m$^2$). Reasons for doing this include reducing cost, reducing the thickness of silver halide emulsion layers to gain sharpness advantages and reducing the environmental impact during and after processing.

One class of low silver photographic material is color material intended for redox amplification processes wherein the developed silver acts as a catalyst to the formation of the dye image. This process can take place in a low volume thin processor, such as a low volume thin tank (LVTT), for example, disclosed in U.S. Pat. No. 5,436,118. Redox amplification processes have been described for example in GB 1,268,126, GB 1,399,481, GB 1,403,418, GB 1,560,572, U.S. Pat. No. 3,748,138, U.S. Pat. No. 3,822,129 and U.S. Pat. No. 4,097,278. In such processes, color materials are developed to produce a silver image (which may contain only small amounts of silver) and are then treated with a redox amplifying solution (or a combined developer-amplifier) to form a dye image.

Besides the improvements in hue, activity and crystal formation, embodiments of the invention also evidence improved dye stability.

EXAMPLE 1

Determination of "NB Couplers"

Using procedures known to those skilled in synthetic chemistry, such as described in J. Bailey, JCS Perkin 1, 1977, 2047, the dyes of the couplers in Table 1 below were prepared by coupling with 4-amino-3-methyl-N-ethyl-N-(2-methane-sulfonamidoethyl) aniline sesquisulfate hydrate, then purified by either crystallization or chromatographic techniques.

A 3% w/v solution of di-n-butyl sebacate (solvent S-1) was made with ethyl acetate and from this solution a 3% solution of the dye based on solvent S-1 was prepared. If the dye was insoluble, dissolution was achieved by the addition of some methylene chloride. The solution was filtered and 0.1–0.2 ml was applied to a clear polyethylene-terephthalate support (approx. 4 cm×4 cm) and spun at 4,000 RPM using the Spin-Coating equipment, Model No. EC101, available from Headway Research Inc., Garland Tex. The normalized (density of 1.00) transmission spectra of the so-prepared dye samples were then recorded. The transmission spectra of the same dye in acetonitrile was also measured and normalized to a density of 1.00.

The $\lambda_{max}$ values, "half bandwidth" (HBW), and "left bandwidth" (LBW) values for each normalized spectra are reported in Table 1 below. The wavelength of maximum absorption was recorded as the $\lambda_{max}$. The half bandwidth (HBW) was obtained by subtracting the wavelength at the point on the left side (short wavelength) of the absorption band where the normalized density is 0.50 from the wavelength at the point on the right side (long wavelength) of the absorption band where the normalized density is 0.50. The left bandwidth (LBW) was obtained by subtracting the wavelength at the point on the left side (short wavelength) of the absorption band where the normalized density is 0.50 from the wavelength of maximum absorption.

In solution, each of the four dyes have similar LBW values. Upon spin-coating, the LBW values of the dyes from IC-7 and IC-35 are 32 nm and 28 nm less than the LBW values of the same dyes in solution, respectively. These couplers therefore meet the criterion defined for "NB couplers". The spin-coating LBW values for the dyes from comparison couplers CC-1 and CC-2 are different from the solution LBW values by only 1 nm, and therefore are not "NB couplers".

TABLE 1

Spin Coating (SC), and acetonitrile solution (Soln.) Data (nm)

| Dye | $\lambda_{max}$ (Soln.) | $\lambda_{max}$ (SC) | HBW (Soln.) | HBW (SC) | LBW (Soln.) | LBW (SC) | Difference = LBW (Soln.) – LBW (SC) |
|---|---|---|---|---|---|---|---|
| IC-7 | 637 | 619 | 123 | 73 | 66 | 34 | 32 |
| IC-35 | 633 | 624 | 123 | 77 | 64 | 36 | 28 |
| CC-1 | 628 | 631 | 121 | 126 | 63 | 62 | 1 |
| CC-2 | 626 | 634 | 124 | 126 | 64 | 63 | 1 |

Comparison Couplers.

CC-1

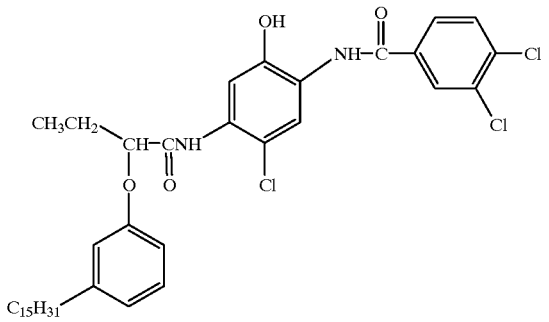

CC-2

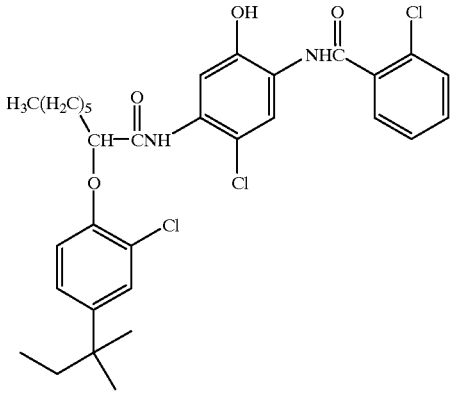

COMPARISON EXAMPLES 2–5

The following comparison examples demonstrate the effects of employing several different NB couplers dispersed in the individual solvents S-1, S-2, S-3, S-4, S-5 and S-6. It will be observed that the latter 5 solvents tend to provide lower levels of crystals but have the drawback of lowering reactivity as measured by gamma significantly.

The following compounds were employed in the examples:

ST-1

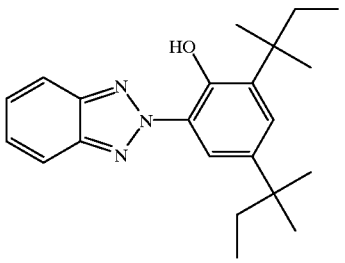

S-1 di-n-butyl sebacate

S-2=V-6 TCHP (tricyclohexyl phosphate)

S-3=VIII-1 BEHS bis-(2-ethylhexyl) sulfoxide

S-4=V-2 tris-2-ethylhexyl phosphate

S-5=V-1 tricresyl phosphate

S-6=IX-1 diethyl dodecanamnide

F-1 Alkanol XC (trademark of E. I. Dupont Co.)

F-2 tetraethylammonium perfluorooctane sulfonate.

H-1 bis(vinylsulfonyl)methane ether

COMPARISON EXAMPLE 2

Dispersion 2-1 was prepared by combining a solution of 5.6 g of Coupler IC-7, 8.4 g of stabilizer ST-1, and 8.4 g of solvent S-1 at 130° C. with an 80° C. solution consisting of 9.0 g decalcified gelatin, 109.5 g de-mineralized water, and 9.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$, 80° C. to produce Dispersion 2-1. This dispersion was then placed in cold storage until ready for combination with a light-sensitive photographic emulsion in a photographic element.

Dispersion 2-2 was prepared as Dispersion 2-1, except replacing coupler IC-7 with coupler IC-35.

Dispersion 2-3 was prepared as Dispersion 2-1, except that a solution of 5.6 g of Coupler IC-7, 4.2 g of ST-1, and 12.7 g of S-1 at 130C was used.

Dispersion 2-4 was prepared as Dispersion 2-3, except replacing coupler IC-7 with coupler IC-35.

Dispersion 2-5 was prepared as Dispersion 2-1, except that a solution of 8.1 g of Coupler IC-35, 4.6 g of ST-1, and 9.7 g of S-1 at 130° C. was used.

Dispersion 2-6 was prepared as Dispersion 2-5, except replacing solvent S-1 with solvent S-2.

Dispersion 2-7 was prepared as Dispersion 2-1 except using a solution of 8.4 g of Coupler IC-7, 2.8 g of ST-1, and 11.3 g of S-1 at 130 C.

Dispersion 2-8 was prepared as Dispersion 2-7, except replacing S-1 with S-2.

To evaluate the amount of crystalline material in each dispersion, samples of Dispersions 2-1 through 2-8 were examined via cross-polar microscopy at 98× magnification after storage of the dispersions at 5° C. for 24 hours. Photographs were taken of Dispersions 2-1 through 2-6 and the number of crystals observed in the approximately 72 mm×94 mm area of the photograph were counted and are reported in Table 2a. Thermal print photographs of Dispersions 2-7 and 2-8 were made using a Kodak 450GL Digital Color Printer and the number of crystals observed in the approximately 86 mm×117 mm area of the photograph were counted and are reported in Table 2a with an (*).

TABLE 2a

Dispersion Crystal Evaluation

| Dispersion | Coupler | Solvent | Coupler (wt fraction) | Solvent (wt fraction) | Stabilizer ST-1 (wt fraction) | Crystals |
|---|---|---|---|---|---|---|
| 2-1 | IC-7 | S-1 | 0.25 | 0.375 | 0.375 | 45 |
| 2-2 | IC-35 | S-1 | 0.25 | 0.375 | 0.375 | 200 |
| 2-3 | IC-7 | S-1 | 0.25 | 0.563 | 0.188 | 75 |
| 2-4 | IC-35 | S-1 | 0.25 | 0.563 | 0.188 | >200 |
| 2-5 | IC-35 | S-1 | 0.361 | 0.432 | 0.206 | 300 |
| 2-6 | IC-35 | S-2 | 0.361 | 0.432 | 0.206 | 50 |
| 2-7 | IC-7 | S-1 | 0.375 | 0.500 | 0.125 | 100* |
| 2-8 | IC-7 | S-2 | 0.375 | 0.500 | 0.125 | 6* |

Dispersions 2-1 to 2-4 of Coupler IC-7 contain significantly fewer crystals than dispersions with IC-35 but both contain well above the single digit level and are unsatisfactory. Dispersions 2-5 to 2-8 show that the use of solvent S-2 with coupler IC-35 reduced the number of crystals to a comparable level with dispersions of IC-7 and the use of solvent S-2 with coupler IC-7 enabled the preparation of a nearly crystal free dispersion. The concern is whether this improvement in the reduction of crystals is offset by any adverse effects on photographic properties.

Coating Evaluation

Photographic elements 201 through 208 were prepared by coating the following layers on a gel-subbed, polyethylene-coated paper support:

| Layer | Component | grams per square meter |
|---|---|---|
| Fourth | Gelatin | 1.08 |
| | Surfactant F-1 | 0.00883 |
| | Surfactant F-2 | 0.00334 |
| | Hardener H-1 | 0.127 |

-continued

| Layer | Component | grams per square meter |
|---|---|---|
| Third | Gelatin | 1.40 |
| Second | Gelatin | 1.66 |
| | Silver from a red-sensitized silver chloride emulsion | 0.150 |
| | Coupler | see table |
| First | Gelatin | 3.23 |
| Support | Gel-subbed polyethylene coated paper | |

Preparation of Processed Photographic Examples

Processed samples were prepared by exposing the coatings through a step wedge and processing in standard Kodak RA-4 processing. The Status A red densities of the processed strips were read and sensitometric curves (density vs log exposure) were generated. The contrast (γ) was measured by calculating the slope of the density vs log exposure plot over the range of 0.6 log E centered on the exposure yielding 1.0 density. This value is reported in Table 2b.

The spectra of the resulting dyes were measured and normalized to a maximum absorption of 1.00. The wavelength of maximum absorption was recorded as the "λmax." As a measure of the sharpness of the curve on the left (short wavelength) side of the absorption band the "left bandwidth" (LBW) was obtained by subtracting the wavelength at the point on the left side of the absorption band where the normalized density is 0.50 from the λmax. A lower value of LBW indicates a reduction in the unwanted green absorption and is thus desirable. Unwanted green absorption from cyan dye was also measured as the amount of density in the normalized spectra at 530 nm. The λmax, LBW, and 530 nm density values are shown in Table 2b. The crystal data from the prior table are repeated for ease of analysis.

TABLE 2b

Photographic Results for Example 2

| Element | Disp # | Coupler | Coupler $g/m^2$ | Solvent | Crystals | γ· | λmax | LBW | Density @ 520 nm |
|---|---|---|---|---|---|---|---|---|---|
| 201 | 2-1 | IC-7 | 0.287 | S-1 | 45 | 2.87 | 622 | 50 | 0.17 |
| 202 | 2-2 | IC-35 | 0.287 | S-1 | 200 | 2.92 | 630 | 52 | 0.152 |

TABLE 2b-continued

Photographic Results for Example 2

| Element | Disp # | Coupler | Coupler g/m$^2$ | Solvent | Crystals | γ· | λmax | LBW | Density @ 520 nm |
|---|---|---|---|---|---|---|---|---|---|
| 203 | 2-3 | IC-7 | 0.287 | S-1 | 75 | 2.89 | 624 | 52 | 0.175 |
| 204 | 2-4 | IC-35 | 0.287 | S-1 | >200 | 2.98 | 628 | 54 | 0.159 |
| 205 | 2-5 | IC-35 | 0.415 | S-1 | 300 | 3.10 | 630 | 54 | 0.157 |
| 206 | 2-6 | IC-35 | 0.415 | S-2 | 50 | 1.91 | 628 | 56 | 0.19 |
| 207 | 2-7 | IC-7 | 0.431 | S-1 | 100* | 3.00 | 620 | 52 | 0.19 |
| 208 | 2-8 | IC-7 | 0.431 | S-2 | 6* | 2.18 | 620 | 54 | 0.223 |

Coupler IC-35 performs comparably to IC-7 when coated in the same format. The use of solvent S-2 to reduce crystals with IC-35 and IC-7 undesirably resulted in 38% and 27% lower γ, respectively, and a higher density at 530 nmn.

COMPARISON EXAMPLE 3

Dispersion 3-1 was prepared by combining a solution of 5.6 g of Coupler IC-7 and 16.9 g of solvent S-1 at 130° C. with an 80° C. solution consisting of 9.0 decalcified gelatin, 109.5 g de-mineralized water, and 9.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$, 80° C. to produce Dispersion 3-1. This dispersion was then placed in cold storage until ready for combination with a light-sensitive photographic emulsion in a photographic element.

Dispersion 3-2 was prepared as Dispersion 3-1, except replacing solvent S-1 with solvent S-3.

Dispersion 3-3 was prepared as Dispersion 3-1, except replacing coupler IC-7 with coupler IC-35.

Dispersion 3-4 was prepared as Dispersion 3-3, except replacing solvent S-1 with solvent S-3.

To evaluate the amount of crystalline material in each dispersion, samples of Dispersions 3-1 through 3-4 were examined via cross-polar microscopy at 98× magnification after storage of the dispersions at 5 C for 24 hours. Thermal prints were made using a Kodak 450GL Digital Color Printer and the number of crystals observed in the approximately 86 mm×117 mm area of the photograph were counted and are reported in Table 3a.

TABLE 3a

Dispersion Crystal Results for Comparison Example 3

| Dispersion | Coupler | Coupler Fraction | Solvent | Solvent Fraction | Crystals |
|---|---|---|---|---|---|
| 3-1 | IC-7 | 0.25 | S-1 | 0.75 | 45 |
| 3-2 | IC-7 | 0.25 | S-3 | 0.75 | 0 |
| 3-3 | IC-35 | 0.25 | S-1 | 0.75 | 200 |
| 3-4 | IC-35 | 0.25 | S-3 | 0.75 | 1 |

The use of solvent S-3 enabled preparation of dispersions of couplers IC-7 and IC-35 which were substantially free of crystals. Photographic elements were prepared and tested as in the preceding example as follows.

Coating Evaluation

Photographic elements 301 through 304 were prepared by coating the following layers on a gel-subbed, polyethylene-coated paper support:

| Layer | Component | grams per square meter |
|---|---|---|
| Fourth | Gelatin | 1.08 |
| | Surfactant F-1 | 0.0137 |
| | Surfactant F-2 | 0 |
| | Hardener H-1 | 0.127 |
| Third | Gelatin | 1.40 |
| Second | Gelatin | 1.36 |
| | Silver from a red-sensitized silver chloride emulsion | 0.150 |
| | Coupler | 0.287 |
| First | Gelatin | 3.23 |
| Support | Gel-subbed polyethylene coated paper | |

TABLE 3b

Results for Comparison Example 3

| Element | Dispersion | Coupler | Solvent | Crystals | γ | λmax | LBW | Density @ 530 nm |
|---|---|---|---|---|---|---|---|---|
| 301 | 3-1 | IC-7 | S-1 | 45 | 3.15 | 624 | 58 | 0.215 |
| 302 | 3-2 | IC-7 | S-3 | 0 | 2.34 | 630 | 76 | 0.327 |
| 303 | 3-3 | IC-35 | S-1 | 200 | 3.22 | 626 | 54 | 0.176 |
| 304 | 3-4 | IC-35 | S-3 | 1 | 2.24 | 626 | 66 | 0.274 |

As in the previous example, the use of the different solvent S-3 undesirably reduced γ by 26% and 30% with couplers IC-7 and IC-35 respectively.

COMPARISON EXAMPLE 4

Dispersion 4-1 was prepared by combining a solution of 4.6 g of Coupler IC-7, 9.3 g of ST-1 and 9.3 g of S-1 at 130 C with an 80° C. solution consisting of 9.0 g decalcified gelatin, 109.5 g de-mineralized water, and 9.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$, 80° C. to produce Dispersion 4-1. This dispersion was then placed in cold storage until ready for combination with a light-sensitive photographic emulsion in a photographic element.

Dispersion 4-2 was prepared as Dispersion 4-1, except replacing coupler IC-7 with coupler IC-35.

Dispersion 4-3 was prepared as Dispersion 4-1, except replacing coupler IC-7 with coupler IC-36.

Dispersion 4-4 was prepared as Dispersion 4-1, except replacing solvent S-1 with solvent S-4.

Dispersion 4-5 was prepared as Dispersion 4-1, except replacing solvent S-1 with solvent S-6.

Dispersion 4-6 was prepared as Dispersion 4-1, except replacing 0.5 g of coupler IC-35 with 0.5 g of coupler IC-36.

Crystals were evaluated as in Example 3.

TABLE 4a

Dispersion Crystal Results for Comparison Example 4

| Dispersion | Coupler 1 | Coupler 2 | % Coupler 2 | Solvent | Crystals |
|---|---|---|---|---|---|
| 4-1 | IC-7 | — | 0% | S-1 | 150 |
| 4-2 | IC-35 | — | 0% | S-1 | 330 |
| 4-3 | IC-36 | — | 0% | S-1 | >400 |
| 4-4 | IC-35 | — | 0% | S-4 | 13 |
| 4-5 | IC-35 | — | 0% | S-6 | 6 |
| 4-6 | IC-35 | IC-36 | 10% | S-1 | 45 |

The use of solvents S-4 and S-6 greatly reduced the number of crystals.

Photographic elements 401 through 408 were prepared as follows, except with silver as specified in table 4b.

| Layer | Component | grams per square meter |
|---|---|---|
| Fourth | Gelatin | 1.08 |
| | Surfactant F-1 | 0.0137 |

-continued

| Layer | Component | grams per square meter |
|---|---|---|
| | Surfactant F-2 | 0 |
| | Hardener H-1 | 0.127 |
| Third | Gelatin | 1.40 |
| Second | Gelatin | 1.36 |
| | Silver from a red-sensitized silver chloride emulsion | 0.156 |
| | Coupler | 0.287 |
| First | Gelatin | 3.23 |
| Support | Gel-subbed polyethylene coated paper | |

Elements 401 through 408 were tested as in Example 2.

TABLE 4b

Results for Comparison Example 4

| Element | Dispersion | Coupler | Solvent | Crystals | γ | λmax | LBW | Density @ 530 nm |
|---|---|---|---|---|---|---|---|---|
| 401 | 4-1 | IC-7 | S-1 | 150 | 3.18 | 624 | 54 | 0.191 |
| 402 | 4-2 | IC-35 | S-1 | 330 | 3.22 | 630 | 56 | 0.163 |
| 403 | 4-3 | IC-36 | S-1 | >400 | 3.19 | 630 | 54 | 0.153 |
| 404 | 4-4 | IC-35 | S-4 | 13 | 2.59 | 630 | 56 | 0.174 |
| 405 | 4-5 | IC-35 | S-6 | 6 | 2.91 | 628 | 56 | 0.19 |
| 406 | 4-6 | IC-35/IC-36 9:1 (wt) | S-1 | 45 | 3.22 | 630 | 52 | 0.153 |

The use of solvents S-4 and S-6 results in an undesirable 20% and 10% reduction in γ, respectively.

COMPARISON EXAMPLE 5

Dispersion 5-1 was prepared by combining a solution of 31.2 g of Coupler IC-35, 3.5 g Coupler IC-36, 57.7 g ST-1, and 57.7 g of solvent S-1 at 145° C. with an 80° C. solution consisting of 60.0 g decalcified gelatin, 493.4 g de-mineralized water, 1.6 g of a 0.7% solution of Kathon LX, and 45.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 562.5 kg/cm$^2$, 75° C. to produce Dispersion 5-1. This dispersion was then placed in cold storage until ready for combination with a light-sensitive photographic emulsion in a photographic element.

Dispersion 5-2 was prepared as Dispersion 5-1, except replacing 8.7 g of ST-1 with ST-19.

Dispersion 5-3 was prepared as Dispersion 5-2, except replacing 57.7 g of solvent S-1 with solvent S-5 and replacing the 3.5 g of coupler IC-36 with a like amount of IC-35. Crystals were evaluated as in Example 3.

TABLE 5a

Dispersion results for Example 5

| Dispersion | Coupler | Solvent | Crystals |
|---|---|---|---|
| 5-1 | IC-35/IC-36 9:1 (wt) | S-1 | 95 |
| 5-2 | same | S-1 | 115 |
| 5-3 | IC-35 | S-5 | 15 |

Use of solvent S-5 resulted in a very low number of crystals.

Photographic elements 501 through 503 were prepared as follows:

| Layer | Component | grams per square meter |
|---|---|---|
| Fourth | Gelatin | 1.08 |
| | Surfactant F-1 | 0.00883 |
| | Surfactant F-2 | 0.00334 |
| | Hardener H-1 | 0.127 |
| Third | Gelatin | 1.40 |
| | ST-1 | 0.128 |
| | ST-19 | 0.023 |
| Second | Gelatin | 1.66 |
| | Silver from a red-sensitized silver chloride emulsion | 0.156 |
| | Coupler (IC-35 + IC-36) | .258 |
| First | Gelatin | 3.23 |
| Support | Gel-subbed polyethylene coated paper | |

Elements 501 through 508 were tested as in Example 2.

TABLE 5b

Results for Comparison Example 5.

| Element | Dispersion | Solvent | Crystals | γ | λmax | LBW | Density @ 530 nm |
|---|---|---|---|---|---|---|---|
| 501 | 5-1 | S-1 | 95 | 3.14 | 632 | 56 | 0.159 |
| 502 | 5-2 | S-1 | 115 | 3.12 | 632 | 56 | 0.158 |
| 503 | 5-3 | S-5 | 15 | 2.86 | 628 | 54 | 0.169 |

A comparison of elements 502 and 503 demonstrates that the use of solvent S-5 results in an undesirable 8.1% decrease in γ, and an increased unwanted density at 530 nm.

INVENTIVE EXAMPLE 6

Dispersion 6-1 was prepared by combining a solution of 73.2 g of Coupler IC-35, 8.1 g of coupler IC-36, 135.6 g of ST-1, and 183.1 g of S-1 at 145 C with an 80 C solution consisting of 160.0 g decalcified gelatin, 1315.7 g de-mineralized water, 4.3 g of a 0.7% solution of Kathon LX, and 120.0 g of a 10% solution of surfactant Alkanol XC (trademark of E. I. Dupont Co.). This combined solution was mixed for one minute at 8000 rpm using a Brinkmann rotor-stator mixer, then homogenized via 1 pass through a Crepaco homogenizer at 352 kg/cm$^2$ to produce Dispersion 6-1. This dispersion was then placed in cold storage until ready for combination with a light-sensitive photographic emulsion in a photographic element.

Dispersion 6-2 was prepared as Dispersion 6-1, except using 160.2 g of solvent S-1 and 22.9 g of solvent S-4.

Dispersion 6-3 was prepared as Dispersion 6-1, except using 137.3 g of solvent S-1 and 45.8 g of solvent S-4.

Crystals were evaluated as in Example 3 and the results were as follows.

TABLE 6a

Dispersion results for Example 6

| Dispersion | Solvent S-1 | Solvent S-4 | Crystals | Comments |
|---|---|---|---|---|
| 6-1 | 100% | 0 | 310 | Comparison |
| 6-2 | 87.5% | 12.5% | 80 | Invention |
| 6-3 | 75% | 25% | 5 | Invention |

Use of only 25% replacement of solvent S-1 with solvent S-4 resulted in a nearly crystal free dispersion. Even the use of 12.5% replacement of S-1 with reduced the number of crystals significantly.

| Layer | Component | grams per square meter |
|---|---|---|
| Fourth | Gelatin | 1.08 |
| | Surfactant F-1 | 0.00883 |
| | Surfactant F-2 | 0.00334 |
| | Hardener H-1 | 0.127 |
| Third | Gelatin | 1.40 |
| | ST-1 | 0.128 |
| | ST-19 | 0.023 |
| Second | Gelatin | 1.66 |
| | Silver from a red-sensitized silver chloride emulsion | 0.156 |
| | Coupler (IC-35 + IC-36) | 0.258 |
| First | Gelatin | 3.23 |
| Support | Gel-subbed polyethylene coated paper | |

Elements 601 through 608 were tested as in Example 2.

TABLE 6b

Results for Example 6.

| Element | Dispersion | Crystals | γ | λmax | LBW | Density @ 530 nm | Comments |
|---|---|---|---|---|---|---|---|
| 601 | 6-1 | 310 | 2.99 | 630 | 54 | 0.159 | Comparison |
| 602 | 6-2 | 80 | 2.94 | 628 | 52 | 0.161 | Invention |
| 603 | 6-3 | 5 | 2.89 | 630 | 56 | 0.165 | Invention |

From Tables 6a and 6b, Elements 602 and 603 demonstrate that using a blend of solvent S-1 and solvent S-4 at a ratio of 7:1 and 3:1 resulted in much improved crystal reductions and decreased y by only 1.7% and 3.3% respectively.

INVENTIVE EXAMPLE 7

Dispersion 7-1 was prepared by combining a solution of 103.8 g of Coupler IC-35, 11.5 g of coupler IC-36, 192.3 g of ST-1, and 192.3 g of solvent S-1 at 145° C. with an 80° C. solution consisting of 200.0 g decalcified gelatin, 1569.6 g de-mineralized water, 5.4 g of a 0.7% solution of Kathon LX, and 225.0 g of a 10% solution of surfactant Alkanol XC (trademark of E. I. Dupont Co.). This combined solution was mixed for one minute at 8000 rpm using a Brinkmann rotor-stator mixer, then homogenized via 1 pass through a Crepaco homogenizer at 352 kg/cm$^2$ to produce Dispersion 7-1. This dispersion was then placed in cold storage until ready for combination with a light-sensitive photographic emulsion in a photographic element.

Dispersions 7-2 through 7-4 were prepared similarly to Dispersion 7-1, varying the oil phase composition as specified in Table 7a.

Crystals were evaluated as in Example 3.

TABLE 7a

Disperison results for Example 7

| Dispersion | wt. fraction (IC-35 + IC-36) | wt. fraction ST-1 | wt. fraction S-1 | wt. fraction S-4 | Crystals | Comment |
|---|---|---|---|---|---|---|
| 6-1 | .23 | .385 | .385 | 0 | 95 | Comparison |
| 6-2 | .23 | .385 | .289 | .096 | 10 | Invention |
| 6-3 | .203 | .339 | .458 | 0 | 155 | Comparison |
| 6-4 | .203 | .339 | .343 | .115 | 0 | Invention |

Use of 25% replacement of solvent S-1 with solvent S-4 to give a #: 1 wt ratio resulted in nearly crystal free dispersions. Multilayer coatings of these dispersions showed similar results to those in Example 6, where the dispersions which replaced 25% of the primary solvent S-4 resulted in γ decreases by only 4% to 8%.

INVENTIVE EXAMPLE 8

Dispersion 8-1 was prepared by combining a solution of 40.1 g of Coupler IC-35, 4.5 g of coupler IC-36, 90.2 g of ST-1, and 90.2 g of solvent S-1 at 145° C. with an 80° C. solution consisting of 90.0 g decalcified gelatin, 1091.8 g de-mineralized water, 3.2 g of a 0.7% solution of Kathon LX, and 90.0 g of a 10% solution of surfactant Alkanol XC (trademark of E. I. Dupont Co.). This combined solution was mixed for one minute at 8000 rpm using a Brinkmann rotor-stator mixer, then homogenized via 1 pass through a Crepaco homogenizer at 352 kg/cm$^2$ to produce Dispersion 8-1. This dispersion was then placed in cold storage until ready for combination with a light-sensitive photographic emulsion in a photographic element.

Dispersion 8-2 was prepared as Dispersion 8-1, except using 76.7 g of stabilizer ST-1 and 13.5 g ST-19.

Dispersion 8-3 was prepared as Dispersion 8-2, except using 67.7 g of solvent S-1 and 22.6 g of solvent S-4.

Dispersion 8-4 was prepared as Dispersion 8-2, except using 45.1 g of solvent S-1 and 45.1 g of solvent S-4.

Dispersion 8-5 was prepared as Dispersion 8-1, except replacing solvent S-1 with solvent S-4.

Crystals were evaluated as in Example 3.

TABLE 8a

Dispersion results for Example 8

| Dispersion | Solvent S-1 | Solvent S-4 | Fresh Crystals | 6 week Crystals | Comments |
|---|---|---|---|---|---|
| 8-1 | 100% | 0 | 24 | 48 | Comparison |
| 8-2 | 100% | 0 | 16 | 34 | Comparison |
| 8-3 | 75% | 25% | 0 | 11 | Invention |
| 8-4 | 50% | 50% | 2 | 10 | Invention |
| 8-5 | 0 | 100% | 6 | 27 | Comparison |

Use of 25% replacement of solvent S-1 with solvent S-4 resulted in a nearly crystal free dispersion. This combination also exhibits good stability in cold storage.

A light sensitive photographic multilayer coating was made to the following format shown in Table 8 below. The dispersions for layer 5 were made to the same method as described in Example 4, but the components in the oil phase were adjusted to achieve the laydowns reported in Table 8.

TABLE 8

Coating format used in Example 8

| Layer | Component | Coverage |
|---|---|---|
| Layer 7 | Gelatin | 0.65 g/m$^2$ |
| Layer 6 | Gelatin | 0.54 g/m$^2$ |
| (UV light absorbing layer) | UV light absorbing agents - (ST-1:ST-19 = 1:0.18) | 0.15 g/m$^2$ |
| | Stain prevention agent, G | 42.0 mg/m$^2$ |
| | Solvents for UV absorbing agents - (A:B, 1:1) | 0.05 g/m$^2$ |
| Layer 5 | Gelatin | 1.36 g/m$^2$ |
| (Red-sensitive layer) | Silver chloride emulsion | 0.151 g/m$^2$ |
| | Couplers (IC-35 + IC-36) | 0.248 g/m$^2$ |
| Layer 4 | Gelatin | 0.71 g/m$^2$ |
| (UV light absorbing layer) | Stain prevention agent, G | 64.6 g/m$^2$ |
| | Solvent for stain prevention agent, A | 0.184 g/m$^2$ |
| Layer 3 | Gelatin | 1.42 g/m$^2$ |
| (green-sensitive layer) | Silver chloride emulsion | 0.08 g/m$^2$ |
| | Magenta coupler, MC-2 | 0.24 g/m$^2$ |
| | Fade prevention agents: (C:D, 1.9:0.3) | 0.24 g/m$^2$ |
| | Solvents for magenta coupler (E:F, 0.35:0.67) | 0.52 g/m$^2$ |
| Layer 2 | Gelatin | 0.75 g/m$^2$ |
| (color stain-preventing layer) | Stain prevention agent, G | 0.11 g/m$^2$ |
| | Solvent for stain prevention agent, A | 0.31 g/m$^2$ |
| Layer 1 | Gelatin | 1.31 g/m$^2$ |
| (blue-sensitive layer) | Hardener, K | 0.15 g/m$^2$ |
| | Silver chloride emulsion | 0.29 g/m$^2$ |
| | Yellow coupler, YC-1 | 0.48 g/m$^2$ |
| | Fade prevention agents-(H:I, 0.26:0.09) | 0.17 g/m$^2$ |
| | Solvent for yellow coupler, S-6 | 0.32 g/m$^2$ |
| Support | Polyethylene laminated paper base | |

Elements through 805 were tested as in Example 2. The contrast (γ) was measured by calculating the slope of the density vs log exposure plot over the range of 0.2 log E less to 0.4 log E more than the exposure yielding 0.8 density.

TABLE 8b

Results for Example 8.

| Element | Dispersion | Crystals | γ | Comments |
|---|---|---|---|---|
| 801 | 8-1 | 24 | 2.752 | Comparison |
| 802 | 8-2 | 16 | 2.744 | Comparison |
| 803 | 8-3 | 0 | 2.566 | Invention |
| 804 | 8-4 | 2 | 2.268 | Invention |
| 805 | 8-5 | 6 | 1.860 | Comparison |

Elements 803 to 805 show decreased γ by 6.5%, 17.4%, and 32.2%, respectively when compared to element 802. Elements 803 and 804 demonstrate the use of a dispersion with a 3:1 or 1:1 wt blend of solvents S-1 and S-4 minimizes loss in reactivity while providing minimized dispersion crystals. Examination of the examples demonstrate that the use of the blend of the coupler solvents of the invention provide dispersions which are essentially crystal free, and with minimized reduction in coupler.

Materials other than those of the invention, which were used in the comparative dispersions or in the preparation of the multilayer photographic elements described in Table 8 are shown below.

Coupler YC-1

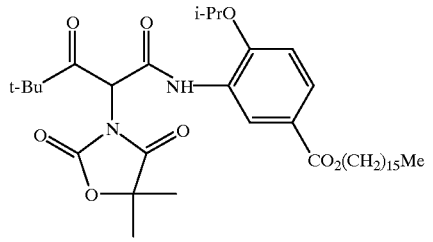

-continued

Coupler MC-2

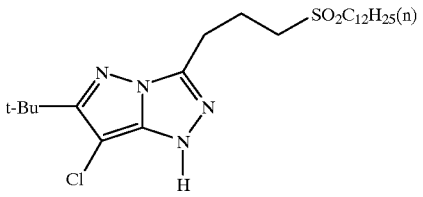

Solvent A

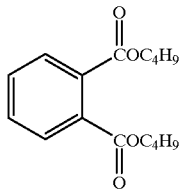

Solvent B

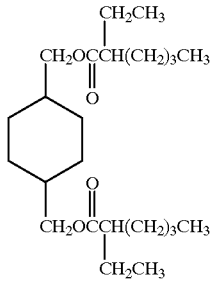

Solvent E

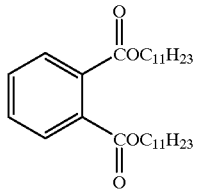

Solvent F $CH_3(CH_2)_7CH{=}CH(CH_2)_8OH$

Layer 3 Fade prevention agent C

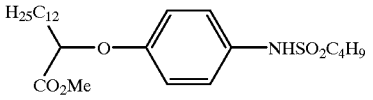

Layer 3 Fade prevention agent D

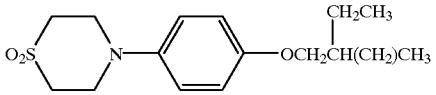

Layer 1 Fade prevention agent H

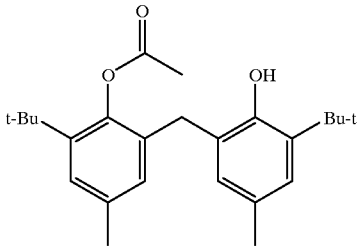

-continued

Layer 1 Fade prevention agent I

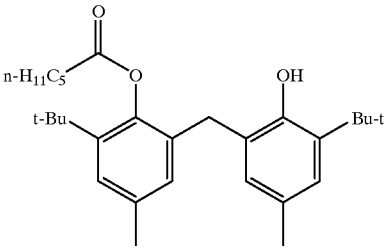

Stain prevention agent G

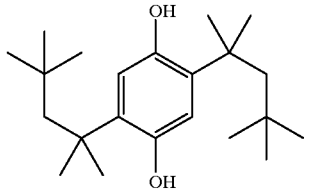

Hardener K

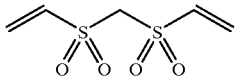

We claim:

1. A photographic element comprising a silver halide emulsion layer having associated therewith:

(a) a phenolic cyan dye-forming "NB coupler";

(b) a first high boiling solvent having Formula (IV):

$$G{-}C{-}OO{-}R^1 \qquad (IV)$$

wherein:

$R^1$ is an alkyl or aryl groups; and

G is an alkyl (including cycloalkyl and aralkyl) containing linking group; and (c) one or more second high boiling solvents selected from phosphates, phosphonates, phosphine oxides, sulfoxides, and carbonamides, said second high boiling solvent being present in amounts (by weight) sufficient to reduce crystal formation in a dispersion of the coupler compared to a dispersion of the same coupler in a dispersion where the second solvent is replaced with a like amount of the first solvent.

2. The element of claim 1 in which the coupler has a melting point of greater than 110° C.

3. The element of claim 2 in which the coupler has a melting point of greater than 130° C.

4. The element of claim 3 in which the coupler has a melting point of greater than 150° C.

5. The element of claim 1 wherein the second solvent is a phosphate.

6. The element of claim 5 in which the phosphate solvent has the formula $O{=}P(OR)_3$ in which each R group is an independently selected alkyl or aryl group.

7. The element of claim 1 wherein the second solvent is a phosphonate.

8. The element of claim 7 in which the phosphonate solvent has the formula $O{=}PR(OR)_2$ in which each R group is an independently selected alkyl or aryl group.

9. The element of claim 1 wherein the second solvent is a phosphine oxide.

10. The element of claim 9 in which the phosphine oxide solvent has the formula $O{=}P(R)_3$ in which each R group is an independently selected alkyl or aryl group.

11. The element of claim 1 wherein the second solvent is a sulfoxide.

12. The element of claim 11 in which the sulfoxide solvent has the formula O═S(R)R in which each R group is an independently selected alkyl or aryl group.

13. The element of claim 1 wherein the second solvent is a carbonamide.

14. The element of claim 13 in which the solvent has the formula O═CR(NR(R)) in which each R group is an independently selected alkyl or aryl group.

15. The element of claim 1 in which the w/w ratio of the first solvent to the second solvent is from about 9:1 to about 1:99.

16. The element of claim 15 in which the w/w ratio of the first solvent to the second solvent is from about 7:1 to about 1:3.

17. The element of claim 16 in which the w/w ratio of the first solvent to the second solvent is from about 4:1 to about 1:1.

18. The element of claim 1 in which the w/w ratio of the sum of the two solvents to the coupler is from about 0.5:1 to about 10:1.

19. The element of claim 18 in which the w/w ratio of the sum of the two solvents to the coupler is from about 1:1 to about 8:1.

20. The element of claim 19 in which the w/w ratio of the sum of the two solvents to the coupler is from about 1:1 to about 5:1.

21. The element of claim 1 in which the first solvent is represented by Formula (II):

$$R^3OO—C—(—G—)—C—OO—R^4 \quad \text{(II)}$$

wherein:

$R^3$ and $R^4$ represent independently selected alkyl or aryl groups; and

G represents an alkyl (including cycloalkyl and aralkyl) containing linking group.

22. The element of claim 1 in which the dispersion additionally comprises a stabilizer having Formula (III):

(III)

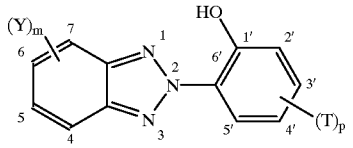

wherein each Y is an independently selected substituent and m is 0 to 4; and each T is an independently selected substituent and p is 0 to 4.

23. The element of claim 1 wherein the left bandwidth (LBW) of the absorption spectra upon "spin coating" in di-n-butyl sebacate the dye formed from coupling the "NB coupler" with the developer 4-amino-3-methyl-N-ethyl-N-(2-methanesulfonamidoethyl) aniline sesquisulfate hydrate is at least 15 nm less than the LBW for a 3% w/v solution of the same dye in acetonitrile.

24. The element of claim 1 wherein the left bandwidth (LBW) of the absorption spectra upon "spin coating" in di-n-butyl sebacate the dye formed from coupling the "NB coupler" with the developer 4-amino-3-methyl-N-ethyl-N-(2-methanesulfonamidoethyl) aniline sesquisulfate hydrate is at least 25 nm less than the LBW for a 3% w/v solution of the same dye in acetonitrile.

25. The element of claim 1 wherein the "NB coupler" has formula (I-A).

(I-A)

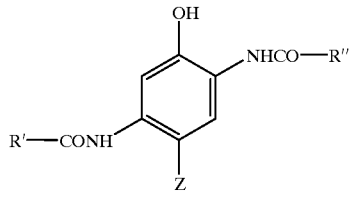

wherein:

R' and R" represent independently selected substituents; and

Z represents a hydrogen atom or a group which can be split off by the reaction of the coupler with an oxidized color developing agent.

26. The element of claim 1 wherein the "NB coupler" has formula (I).

(I)

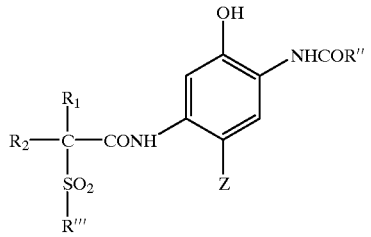

wherein:

$R_1$ and $R_2$ are independently hydrogen or an alkyl group; and

R" and R'" are independently an alkyl, amino, aryl or heterocyclic group.

27. The element of claim 1 which provides a positive image for viewing.

28. The element of claim 1 that provides the image on a reflective support.

29. The element of claim 27 that provides the image on a transparent support for projection viewing.

30. A process for forming an image in the element of claim 1 comprising contacting the element with a color developing agent after the element has been imagewise exposed.

* * * * *